US008192905B2

(12) United States Patent
Shimoyama et al.

(10) Patent No.: US 8,192,905 B2
(45) **Date of Patent: *Jun. 5, 2012**

(54) ELECTROPHOTOGRAPHIC PHOTOCONDUCTOR, IMAGE FORMING APPARATUS, AND PROCESS CARTRIDGE

(75) Inventors: Keisuke Shimoyama, Numazu (JP); Eiji Kurimoto, Numazu (JP); Shinichi Kawamura, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 327 days.

This patent is subject to a terminal disclaimer.

(21) Appl. No.: 11/736,919

(22) Filed: Apr. 18, 2007

(65) Prior Publication Data

US 2007/0248901 A1 Oct. 25, 2007

(30) Foreign Application Priority Data

Apr. 20, 2006 (JP) ..... 2006-116457
Aug. 24, 2006 (JP) ..... 2006-227576

(51) Int. Cl.
*G03G 5/06* (2006.01)

(52) U.S. Cl. ..... 430/73; 430/78; 430/970; 399/159

(58) Field of Classification Search ..... 430/56, 430/58.5, 58.75, 73, 78, 970; 399/116, 159
See application file for complete search history.

(56) References Cited

U.S. PATENT DOCUMENTS 5,578,405 A 11/1996 Ikegami et al.
5,702,855 A * 12/1997 Ikegami et al. ..... 430/83
5,976,746 A 11/1999 Tanaka et al.
6,022,998 A * 2/2000 Kawaguchi et al. ..... 564/434
6,066,428 A 5/2000 Katayama et al.
6,172,176 B1 1/2001 Tanaka et al.
6,187,492 B1 2/2001 Ri et al.
6,194,535 B1 2/2001 Katayama et al.
6,210,848 B1 4/2001 Nagai et al.
6,432,596 B2 8/2002 Ikuno et al.
6,444,387 B2 9/2002 Ri et al.
6,486,293 B1 11/2002 Ri et al.
6,548,216 B2 4/2003 Kawamura et al.
6,576,386 B1 6/2003 Ri et al.
6,790,571 B2 9/2004 Kawamura et al.
6,919,419 B2 7/2005 Ri et al.
6,936,388 B2 8/2005 Suzuki et al.
6,974,654 B2 12/2005 Kawamura et al.
7,056,633 B2 6/2006 Kawamura et al.
7,071,285 B2 7/2006 Kawamura et al.
7,122,284 B2 10/2006 Kawamura et al.
7,160,658 B2 1/2007 Suzuki et al.
7,747,197 B2 * 6/2010 Shimoyama et al. ..... 399/159
7,871,747 B2 * 1/2011 Shimoyama et al. ..... 430/64
7,919,220 B2 * 4/2011 Shimoyama et al. ..... 430/78
2004/0033428 A1 * 2/2004 Niimi ..... 430/59.5
2004/0190932 A1 * 9/2004 Ishii ..... 399/110
2005/0053853 A1 3/2005 Sugino et al.
2005/0058918 A1 3/2005 Kurimoto et al.
2005/0118518 A1 6/2005 Ikegami et al.
2006/0067730 A1 3/2006 Uratani et al.
2007/0059039 A1 3/2007 Shimoyama et al.
2007/0059618 A1 3/2007 Kurimoto et al.
2007/0059619 A1 3/2007 Shimoyama et al.
2007/0219375 A1 * 9/2007 Fujiyama et al. ..... 546/278.7

FOREIGN PATENT DOCUMENTS

CN 1755544 A 4/2006

(Continued)

OTHER PUBLICATIONS

Diamond, A.S., ed., Handbook of Imaging Materials, Marcel Dekker, Inc., NY (1991), pp. 395-396.*

(Continued)

*Primary Examiner* — Janis L Dote
(74) *Attorney, Agent, or Firm* — Oblon, Spivak, McClelland, Maier & Neustadt, L.L.P.

(57) ABSTRACT

An electrophotographic photoconductor contains a photosensitive layer and a conductive substrate, wherein the photosensitive layer is disposed on the conductive substrate, and the photosensitive layer is a single layer containing a charge generating material, an electron transporting material expressed by the General Formula (1) and a hole transporting material expressed by the General Formula (2):

General Formula (1)

General Formula (2)

9 Claims, 6 Drawing Sheets

FOREIGN PATENT DOCUMENTS

| | | | |
|---|---|---|---|
| EP | 1 176 469 | A1 | 1/2002 |
| EP | 1 736 476 | A1 | 12/2006 |
| JP | 6-130688 | | 5/1994 |
| JP | 10-115941 | | 5/1998 |
| JP | 2001-19871 | | 1/2001 |
| JP | 2001-34000 | | 2/2001 |
| JP | 2001-109173 | | 4/2001 |
| JP | 3183807 | | 4/2001 |
| JP | 2001-175010 | | 6/2001 |
| JP | 2001-255678 | | 9/2001 |
| JP | 3239244 | | 10/2001 |
| JP | 2002-040679 | | 2/2002 |
| JP | 3273543 | | 2/2002 |
| JP | 2003-107759 | | 4/2003 |
| JP | 3471163 | | 9/2003 |
| JP | 2005-126367 | | 5/2005 |
| JP | 2005-128496 | | 5/2005 |
| JP | 2005-234543 | | 9/2005 |
| JP | 2006-28027 | | 2/2006 |
| JP | 2006-195056 | | 7/2006 |
| WO | WO 2005/092901 | A1 | 10/2005 |

OTHER PUBLICATIONS

Diamond, A,S., et al, ed. Handbook of Imaging Materials, Second Edition, Marcel Dekker, Inc., NY (2002), pp. 410-411.*

U.S. Appl. No. 12/036,779, filed Feb. 25, 2008, Kurimoto, et al.

Japanese Office Action dated Aug. 16, 2010 as received in the corresponding Japanese Application No. 2006-116457.

Office Action issued Sep. 30, 2010, in Japan Patent Application No. 2006-227576.

* cited by examiner

ELECTROPHOTOGRAPHIC PHOTOCONDUCTOR, IMAGE FORMING APPARATUS, AND PROCESS CARTRIDGE

BACKGROUND OF THE INVENTION

1. Field of the Invention

The present invention relates to a single-layer electrophotographic photoconductor containing a photosensitive layer which contains at least a certain electron transporting material and a hole transporting material.

The present invention also relates to a positively charged electrophotographic photoconductor, a positively charged image forming apparatus and a process cartridge using the positively charged electrophotographic photoconductor which contains a single photosensitive layer containing a combination of a certain charge transporting material and an organic sulfur antioxidant, and does not generate an abnormal image such as afterimage even after repeated use.

2. Description of the Related Art

In recent years, developments of information processing system using electrophotographic system are remarkable. Particularly the optical printers in which information is converted to digital signals to be recorded by light have been notably improved in terms of printing quality and reliability. The digital recording technique of this type is also applied to general copiers as well as printers and so-called "digital copiers" have been developed. Moreover, the demand for the copiers in which the conventional copiers which have been provided with the digital recording technique is expected to increase more in the future because of additional various information processing functions. Furthermore, developments of digital color printers for outputting color images and documents are drastically advancing with popularization and upgrade of personal computers.

The electrophotographic photoconductor used in the image forming apparatuses as described above can be classified broadly into an organic photoconductor and an inorganic photoconductor. The organic photoconductors are being widely used recently because it can be manufactured easily and inexpensively as compared with the conventional inorganic photoconductors, and there is a lot of flexibility in functional designs because of various choices for photoconductor materials including a charge transporting material, a charge generating material, a binder resin, and the like.

Examples of the organic photoconductors include a single-layer photoconductor in which the charge transporting material (a hole transporting material and an electron transporting material) is dispersed together with the charge generating material in a photosensitive layer, and a multilayer photoconductor in which a charge generating layer containing the charge generating material, and the charge transporting layer containing the charge transporting material are layered.

The multilayer photoconductors are mostly negatively charged, and the positively charged multilayer photoconductor has not been achieved in practical use. This is because the electron transporting material which is excellent in electron transporting ability, less toxicity, and has high compatibility with the binder resin has not been achieved yet.

On the other hand, the single-layer photoconductor in which the charge generating material and the charge transporting material are contained in a single-layer photosensitive layer has been drawing attention recently for the following reasons: capable of manufacturing by a simple manufacturing process; improvement of optical property due to fewer layer interfaces; capable of positively charged with excellent in uniform charge property and the small amount of generated ozone due to having sensitivity of both positive and negative polarity by containing the electron transporting material and the hole transporting material.

In the single-layer photoconductor, the charge generating material is generally contained throughout the photosensitive layer, thus, charge is basically generated throughout the layer. A semiconductor laser (LD) and a light emitting diode (LED) are generally used as the light sources for exposing in the digital image forming apparatus of recent years, and its wavelength is mainly near infrared of approximately 680 nm to 830 nm. With the light source of the long wavelength range, and the light is penetrated into the depth of the photosensitive layer, and hole-electron pairs are formed throughout the layer. This may easily interfere the mobility of the hole and the electron due to the difference between the mobility of the hole and that of the electron, structural defect, and recombination.

Therefore the single-layer photoconductor easily invites less sensitivity and rise of residual potential after repeated use, and may easily generate an abnormal image so-called "afterimage".

An image forming apparatus using an electrophotographic system generally forms an image by charging a photoconductor (charging step), exposing imagewise to form a latent electrostatic image (exposing step), developing the latent electrostatic image by applying a developing bias voltage to form a toner image (developing step), transferring the toner image on a transfer paper (transferring step), and fixing. A residual toner on the photoconductor is cleaned by an urethane blade and the like (cleaning step), and residual potential on the photoconductor is remove by LED and the like (charge removing step).

The afterimage is generated such that carriers accumulate in the exposed part in the exposing step, and the effect of exposing is remained even after the charge removing step, which is exposed again with generating potential difference in the next charging step. Thus the electric potential in the exposed part after exposing is lower than the circumference, and then the afterimage is generated as nonuniform density on an image.

Japanese Patent Application Laid-Open (JP-A) Nos. 8-328275, 7-64301, 9-281729, 6-130688, and 9-151157 disclose the conventional single-layer photoconductors. Their properties are not satisfied because the properties are significantly lowered, and afterimage is generated after repeated use.

In a negatively charged photoconductor, corona discharge is unstable as compared to in a positively charged photoconductor, and ozone and nitrogen oxides are generated. These are adsorbed to the surface of the photoconductor and easily cause physical and chemical degradation, moreover, adversely affect to the environment. Therefore, the positively charged photoconductor is more widely used than the negatively charged photoconductor due to greater flexibility in use condition.

The single-layer photoconductor is exemplified as the positively charged photoconductor. The single-layer photoconductor mainly contains both of the electron transporting material and the hole transporting material as a charge transporting material. Thus, the single-layer photoconductor has a sensitivity of positive and negative polarity. However, most of the single-layer photoconductor is positively charged because of the higher sensitivity in positive charge due to the lower electron transporting ability of the electron transporting material, and benefit from the positive charge.

The conventional single-layer photoconductors disclosed in Japanese Patent Application Laid-Open (JP-A) Nos. 8-328275, 7-64301, 9-281729, 6-130688, and 9-151157. These single-layer organic photoconductors have problems inherent in the single-layer photoconductor such that higher residual potential, and greater fluctuation in charged electric potential due to repeated electrostatic fatigue and in electric potential after exposing as compared to a separated-function multilayer photoconductor.

To solve the problem of the single-layer photoconductor, in recent years, a novel electron transporting material has been developed. Particularly, International Publication No. WO 2005/092901 discloses a tetracarboxylic acid derivative, and a naphthalenecarboxylic acid derivative which have excellent electron transporting ability, thus the problem of the conventional single-layer photoconductor can be solved, and electrostatic property is greatly improved.

An electron transporting material expressed by the General Formula (1) in the present invention which is disclosed in International Publication No. WO 2005/092901 has an excellent electron transporting ability. The single-layer photoconductor using the electron transporting material is an excellent single-layer photoconductor because it has high sensitivity, and is less decrease of sensitivity after repeated use. However, there is a problem that the single-layer photoconductor using the electron transporting material has low charge property the same as the conventional single-layer photoconductor. The single-layer photoconductor also has low charge stability, thus the charged electric potential is lowered after repeated use, and abnormal images such as background smear and fog may easily generate.

Moreover, the single-layer photoconductor has a problem that an afterimage (memory image) is easily generated. In the reversal developing system which is a mainstream system in digital image forming apparatus of recent years, the photoconductor is charged, an image part is exposed, the part of the lower surface potential of the photoconductor is developed using the toner having the same polarity with the photoconductor, and bias voltage of reversal polarity is applied to the photoconductor so as to transfer a toner image to a transfer medium in the transferring step. In the transferring step, the surface potential of the image part is reversely charged from main potential of the photoconductor in the transferring step, because the reversal bias is applied to the image part in the condition of low surface potential. The single-layer photoconductor has the sensitivity of both positive and negative polarity because it contains the electron transporting material and the hole transporting material. When the image part is reversely charged, the polarity can be partially cancelled by charge removal by light, but can not completely cancelled. Thus potential difference remains. The photoconductor having enough charging ability can cancel the potential difference in the next charging step, and can be uniformly charged. The photoconductor having lower charging ability cannot cancel the potential difference in the next charging step, and a record of the prior image remains in the next image.

The single-layer photoconductor has low charge stability, and easily generates the afterimage after repeated use.

The electron transporting material expressed by the General Formula (1) may significantly improves the sensitive property of the single-layer photoconductor, however, it has a problem in charging ability the same as the conventional single-layer photoconductor, and an afterimage is easily generated after repeated use. Therefore, the sufficient result has not been obtained at present.

BRIEF SUMMARY OF THE INVENTION

The object of the present invention is to provide a single-layer photoconductor has high sensitivity, and does not generate an abnormal image such as afterimage even after repeated use.

The object of the present invention is also to provide a positively charged single-layer photoconductor which has high sensitivity, excellent charge stability, and does not generate an abnormal image such as afterimage even after repeated use.

As described above, it is assumed that the afterimage is caused by accumulation of carriers at an exposed part. Therefore, in the single-layer photoconductor the electron transporting material and the hole transporting material are required to have a sufficient electron transfer ability.

In general, the carriers are easily accumulated because the charge transporting ability of the electron transporting material is not sufficient. However, the electron transporting material expressed by the General Formula (1) of the present invention has an excellent electron transporting ability. Therefore, the electron transporting material expressed by the General Formula (1) is used to make the high sensitive single-layer photoconductor which has sufficient electron transporting ability, and hole transporting ability.

However, even in the single-layer photoconductor having sufficient charge transporting ability, repeated use invites easy generation of afterimage.

The present inventors have considered the hole transporting material to be combined in the single-layer photoconductor containing the electron transporting material expressed by the General Formula (1), and found out that the photoconductor containing the combination of the electron transporting material expressed by the General Formula (1) and the hole transporting material expressed by the General Formula (2) does not generate afterimage even after repeated use.

As described above, the afterimage is generated because the polarity of the image part is reversed (−) relative to the main polarity of the photoconductor (+) in the transferring step, and potential difference cannot be completely cancelled in the next charging step. Therefore, the photoconductor is required to have sufficient charging ability in order to cancel the potential difference generated in the transferring step to prevent the afterimage. The inventors have been considered the improvement of charge property in the single-layer photoconductor using the electron transporting material expressed by the General Formula (1), and found out that the charge property is improved by adding certain material selected from antioxidants which is conventionally used in the plastic material and rubber material, and afterimage is not generated even after repeated use.

The aspects of the present invention as follows:

<1> An electrophotographic photoconductor containing a photosensitive layer and a conductive substrate, wherein the photosensitive layer is disposed on the conductive substrate, and the photosensitive layer is a single layer which contains a charge generating material, an electron transporting material expressed by the General Formula (1) and a hole transporting material expressed by the General Formula (2):

General Formula (1)

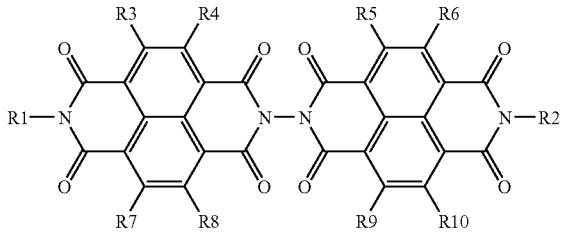

wherein R1 and R2 independently represent any one of a hydrogen atom, substituted or unsubstituted alkyl group, substituted or unsubstituted cycloalkyl group and substituted or unsubstituted aralkyl group, and R3, R4, R5, R6, R7, R8, R9 and R10 independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group;

General Formula (2)

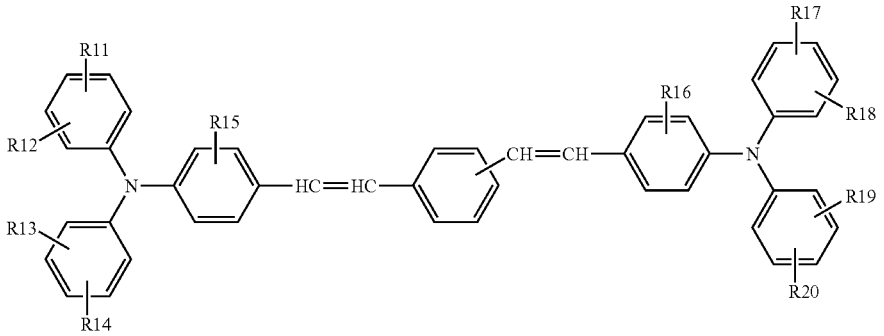

wherein R1, R12, R13, R14, R17, R18, R19 and R20 each represents a hydrogen atom, halogen atom, alkoxy group, alkyl group which may be substituted or aryl group which may be substituted, R15 and R16 each represents a hydrogen atom, halogen atom, alkyl group, and alkoxy group.

<2> The electrophotographic photoconductor according to <1>, wherein the charge generating material is phthalocyanine.

<3> The electrophotographic photoconductor according to <2>, wherein the phthalocyanine is titanyl phthalocyanine.

<4> The electrophotographic photoconductor according to <3>, wherein the titanyl phthalocyanine has a maximum diffraction peak at least at a Bragg angle 2θ(±0.2°) of 27.2°, main diffraction peaks at Bragg angles 2θ(±0.2°) of 9.4°, 9.6° and 24.0°, a diffraction peak at the smallest Bragg angle 2θ(±0.2°) of 7.3°, and no diffraction peaks at Bragg angles 2θ(±0.2°) between 7.3° and 9.4° in its X-ray diffraction spectrum for CuKα X-ray (1.542 Å wavelength).

<5> An image forming apparatus containing an electrophotographic photoconductor according to <1>.

<6> The image forming apparatus according to <5>, wherein the image forming apparatus contains a plurality of electrophotographic photoconductors, and a unicolor toner image developed on each electrophotographic photoconductor is sequentially superimposed so as to form a color image.

<7> The process cartridge for an image forming apparatus, containing the electrophotographic photoconductor according to <1>, wherein the process cartridge is detachably attached to the image forming apparatus.

<8> An image forming apparatus containing the process cartridge according to <7>.

<9> An image forming apparatus containing a plurality of process cartridges according to <7>.

<10> An electrophotographic photoconductor containing a photosensitive layer and a conductive substrate, wherein the photosensitive layer is disposed on the conductive substrate, and the photosensitive layer is a single layer which contains a charge generating material, an organic sulfur antioxidant and an electron transporting material expressed by the General Formula (3):

General Formula (3)

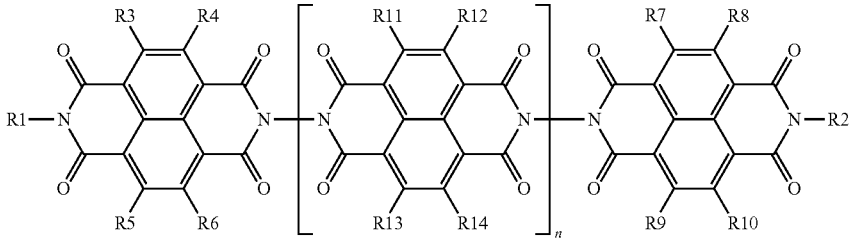

wherein R1 and R2 independently represent any one of a hydrogen atom, substituted or unsubstituted alkyl group, substituted or unsubstituted cycloalkyl group and substituted or unsubstituted aralkyl group, and R3, R4, R5, R6, R7, R8, R9, R10, R11, R12, R13 and R14 independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group, and "n" is a repeating unit and represents an integer of 0 to 100, and wherein the electrophotographic photoconductor is positively charged.

<11> The electrophotographic photoconductor according to <10>, wherein the organic sulfur antioxidant is a compound expressed by the General Formula (4):

$$S—(CH_2CH_2COOC_nH_{2n+1})_2 \qquad \text{General Formula (4)}$$

wherein, "n" represents an integer of 8 to 25.

<12> The electrophotographic photoconductor according to <10>, wherein the charge generating material is phthalocyanine.

<13> The electrophotographic photoconductor according to <12>, wherein the phthalocyanine has a maximum diffraction peak at least at a Bragg angle 2θ(±0.2°) of 27.2°, main diffraction peaks at Bragg angles 2θ(±0.2°) of 9.40, 9.60 and 24.0°, a diffraction peak at the smallest Bragg angle 2θ(±0.2°) of 7.30, and no diffraction peaks at Bragg angles 2θ(±0.2°) between 7.3° and 9.4° in its X-ray diffraction spectrum for CuKα X-ray (1.542 Å wavelength).

<14> The image forming apparatus containing the electrophotographic photoconductor according to <10>.

<15> The image forming apparatus according to <14>, wherein a developing system is a reversal developing system.

<16> A process cartridge for an image forming apparatus, containing the electrophotographic photoconductor according to <10>, wherein the process cartridge for the image forming apparatus is detachably attached to the image forming apparatus.

The electron transporting material expressed by the General Formula (1) of the invention has an excellent electron transporting ability and the hole transporting material expressed by the General Formula (2) has an excellent hole transporting ability. Thus, the photoconductor containing the combination of both has a high sensitivity and is excellent in electron and hole transfer ability respectively.

In the photoconductor containing the electron transporting material expressed by the General Formula (1), and the hole transporting material expressed by the General Formula (2) as a charge transporting material of the present invention, properties such as sensitivity, residual potential and charge property are stable even after repeated use. This is because the electron transporting material expressed by the General Formula (1) and the hole transporting material expressed by the General Formula (2) are compatible with each other, and the electron transporting material expressed by the General Formula (1) has an excellent resistance to oxidized gas generated in the charging step.

Generally, the electron transporting material and the hole transporting material form a charge transfer complex which absorbs light in a wavelength range where the electron transporting material or the hole transporting material dose not individually absorb the light. This absorption occurs in a wavelength range of approximately 600 nm to 800 nm. That is, the transmittance of a photosensitive layer may be decreased in the wavelength range of LD or LED (approximately 680 nm to 830 nm) which is widely used for a light source for exposing in the digital image forming apparatus of recent years.

The combination of the electron transporting material expressed by the General Formula (1) and the hole transporting material expressed by the General Formula (2) of the present invention specifically greatly decreases the transmittance.

When the transmittance of the photosensitive layer is decreased, light does not reach the depth of the photosensitive layer, thus, charge is generated by exposing only near the surface of the photosensitive layer. Thus, travel distance of the carrier from the charge generation to the charge cancellation on the surface becomes shorter when the latent electrostatic image is formed. And then, it is not easily affected by Coulomb repulsion, the latent image which is true to exposing and has high resolution can be formed.

When the carriers are generated throughout the photosensitive layer, carrier transfer may be easily interfered by the interaction among the generated carriers, and then afterimage is generated and sensitivity is lowered due to accumulation of the carriers. When the electron transporting material expressed by the General Formula (1) and the hole transporting material expressed by the General Formula (2) of the invention are combined, charge is generated only near the surface of the photosensitive layer, and the generation of the unnecessary carrier in the photosensitive layer may be inhibited, thereby the carrier transfers smoothly.

The single-layer photoconductor containing the electron transporting material expressed by the General Formula (1) and the hole transporting material expressed by the General Formula (2) of the present invention is excellent in the charge transporting ability of the electron transporting material and the hole transporting material, forms a charge transfer complex which significantly reduces transmittance of the photosensitive layer and inhibits the generation of the unnecessary carrier in the photosensitive layer. Therefore, the reduction in photoconductor property and generation of afterimage can be inhibited even after repeated use.

The photoconductor property may be improved by using a specific material for the charge generating material. In the present invention, known materials can be used as the charge generating material. Among these, the material having a phthalocyanine structure is preferred in combination with the charge transporting material (the electron transporting material and the hole transporting material) of the invention, and this enables the photoconductor to have lower residual potential, and less lowered property after repeated use of the photoconductor.

Among these, titanyl phthalocyanine expressed by the Structural Formula (1) having titanium as a central metal is contained so that photoconductor can have particularly high sensitivity, and then the image forming apparatus can be further speeded up.

Structural Formula (1)

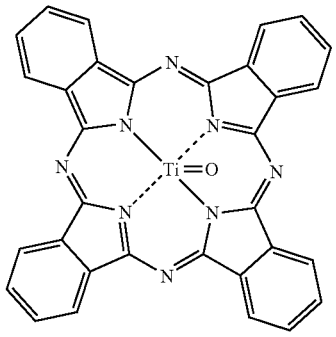

The synthesis of titanyl phthalocyanine and the electrophotographic property are disclosed in Japanese Patent Application Laid-Open (JP-A) Nos. 57-148745, 59-36254, 59-44054, 59-31965, 61-239248, 62-67094 and the like. Various crystal systems of titanyl phthalocyanine are known, and a variety of crystalline forms of titanyl phthalocyanine are disclosed in Japanese Patent Application Laid-Open (JP-A) Nos. 59-49544, 59-166959, 61-239248, 62-67094, 63-366, 63-116158, 64-17066, and 2001-19871.

Among these crystals, the titanyl phthalocyanine having a maximum diffraction peak at a Bragg angle 2θof 27.2° exhibits particularly excellent sensitivity, and preferably used. JP-A No. 2001-19871 discloses a titanyl phthalocyanine having a maximum diffraction peak at a Bragg angle 2θof 27.2°, main diffraction peaks at Bragg angles 2θof 9.4°, 9.6° and 24.0°, a diffraction peak at the smallest Bragg angle 2θof 7.30, and no diffraction peaks at Bragg angles 2θ(±0.2°) between 7.3° and 9.4°. By using the titanyl phthalocyanine, an electrophotographic photoconductor without loss of high sensitivity and reduction of charge property after repeated use can be obtained.

Generally, addition of the additives such as an antioxidant in the photosensitive layer resulted not only in the improvement of charge property, but also in adverse affect such as reduction of sensitivity and increase of residual potential. However, in the single-layer photoconductor containing electron transporting material expressed by the General Formula (3) of the invention, the addition of the organic sulfur antioxidant improves charge property with little adverse affect such as reduction of sensitivity and increase of residual potential. Therefore, an abnormal image (for example, background smear and fog) and afterimage caused by reduction of charge property can be prevented even after repeated use.

In addition, when the organic sulfur antioxidant is used, a specific phenomenon occurs that the positive charge property is increased while negative charge property is drastically decreased (see evaluation example described hereinbelow). The cause of the phenomenon has not been revealed, and it is assumed that the drastical decrease of the negative charge property prevents the photoconductor from negatively charged in the transferring step, consequently the potential difference becomes smaller after transferring, and afterimage is much more hard to be generated.

The electron transporting material expressed by the General Formula (3) has excellent electron transporting ability, thus the photoconductor of the present invention has excellent sensitivity in both positive and negative polarity. Therefore, a charge removing step by light performed in an image forming apparatus allows potential difference generated in the transferring step to be fully minimized, and afterimage is not easily generated.

By containing the phthalocyanine as the charge generating material in the photoconductor, the photoconductor can have higher sensitivity, lower residual potential, and less degradation of property even after repeated use of the photoconductor. Among these, the titanyl phthalocyanine expressed by the Structural Formula (1) having titanium as a central metal is contained so that photoconductor can have particularly high sensitivity.

Structural Formula (1)

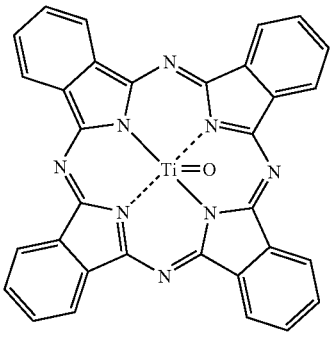

A variety of crystalline forms of titanyl phthalocyanine are known. Among these, the titanyl phthalocyanine having a maximum diffraction peak at a Bragg angle 2θof 27.2° particularly exhibits excellent sensitivity. JP-A No. 2001-19871 discloses a titanyl phthalocyanine having a maximum diffraction peak at a Bragg angle 2θof 27.2°, main diffraction peaks at Bragg angles 2θof 9.4°, 9.6° and 24.0°, a diffraction peak at the smallest Bragg angle 2θof 7.3°, and no diffraction peaks at Bragg angles 2θ(±0.2°) between 7.3° and 9.4°. By containing the titanyl phthalocyanine, a stable electrophotographic photoconductor having high sensitivity with less reduction of charge property after repeated use can be obtained.

According to the present invention, a high sensitive single-layer photoconductor without generating an abnormal image such as afterimage after repeated use can be provided. Moreover, an image forming apparatus which can form a high quality image for a long period is provided by using the single-layer photoconductor. A process cartridge which is convenient in handling is also provided.

According to the present invention, a positively charged single-layer photoconductor having high sensitivity and excellent charge stability can be provided without generating an abnormal image such as afterimage after repeated use. Moreover, an image forming apparatus which can form a high quality image for a long period is provided by using the positively charged single-layer photoconductor. A process cartridge which is convenient in handling is also provided.

DETAILED DESCRIPTION OF THE INVENTION

With reference to the drawings, the electrophotographic photoconductor of the present invention will be explained in detail hereinbelow.

Figure 7:
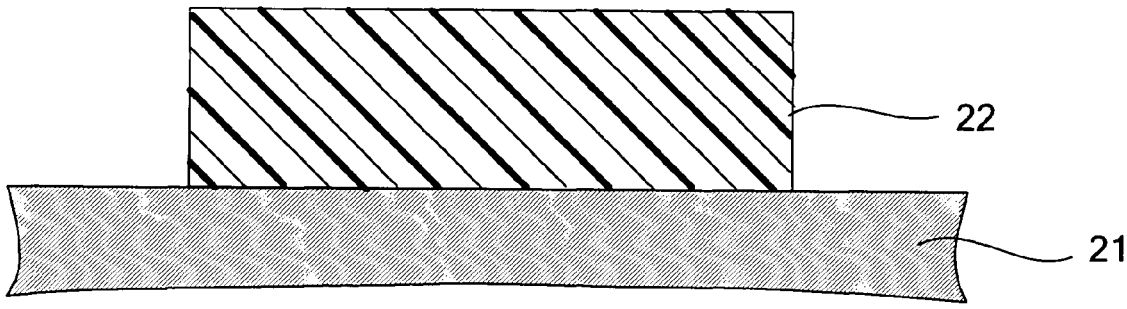
FIG. 7 is a cross-sectional view showing an example of a layer composition of an electrophotographic photoconductor of the present invention.

FIG. 7 is a schematic cross-sectional view showing an example of an electrophotographic photoconductor having a layer composition of the present invention, in which a photosensitive layer 22 is disposed on a conductive substrate 21.

For the conductive substrate 21, the conductive substrates having a volume resistance of $10^{10}\Omega\cdot$cm or less are used. Examples thereof include a conductive substrate obtained by coating a metal such as aluminum, nickel, chrome, nichrome, copper, silver, gold, iron or platinum, or a metal oxide such as tin oxide or indium oxide on film-shaped or cylindrical plastic or paper by means of vapor deposition or sputtering; an aluminum plate, aluminum alloy plate, nickel plate, or stainless plate; and a conductive substrate obtained by forming the plate of aluminum, aluminum alloy, nickel, or stainless into a tube by means of Drawing Ironing, Impact Ironing, Extruded Ironing, Extruded Drawing, and cutting, and by subjecting the tube to surface treatment such as cutting, superfinishing, and/or polishing.

The photosensitive layer of the first embodiment of the present invention is a single layer containing the charge generating material, the electron transporting material expressed by the General Formula (1), and the hole transporting material expressed by the General Formula (2).

The photosensitive layer of the second embodiment of the present invention is a single layer containing the charge generating material, the electron transporting material expressed by the General Formula (3), and the organic sulfur antioxidant.

First, the charge generating material of the present invention will be explained.

For the charge generating material of the present invention, known materials can be used. Examples thereof include phthalocyanine pigment such as metal phthalocyanine, and metal-free phthalocyanine, azlenium salt pigment, squalic acid methane pigment, azo pigments such as azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone or polycyclic quinone pigments, quinoneimine pigment, diphenylmethane and triphenylmethane pigments, benzoquinone and naphthoquinone pigments, cyanine and azomethine pigments, indigoid pigment, and bisbenzimidazole pigment. These charge generating material may be used alone or in combination.

In the present invention, phthalocyanine pigment is preferred in terms of various properties necessary for the present invention.

Among these, titanyl phthalocyanine expressed by the Structural Formula (1) having titanium as a central metal allows the photoconductor to have a photosensitive layer having high sensitivity, and image forming apparatus (hereinafter also referred to as electrophotographic apparatus) can be further speeded up. Moreover, among a variety of crystalline forms, the titanyl phthalocyanine having a maximum diffraction peak at a Bragg angle 2θof 27.2° exhibits particularly excellent sensitivity, and is preferably used. JP-A No. 2001-19871 discloses a titanyl phthalocyanine having a maximum diffraction peak at a Bragg angle 2θof 27.2°, main diffraction peaks at Bragg angles 2θof 9.4°, 9.6° and 24.0°, a diffraction peak at the smallest Bragg angle 2θof 7.3°, and no diffraction peaks at Bragg angles 2θ(±0.2°) between 7.3 and 9.4. By using the titanyl phthalocyanine, a stable electrophotographic photoconductor can be obtained without loss of high sensitivity and reduction of charge property after repeated use.

Next, the charge transporting material will be explained.

The charge transporting material expressed by the General Formula (1) of the present invention has the following structural skeleton:

General Formula (1)

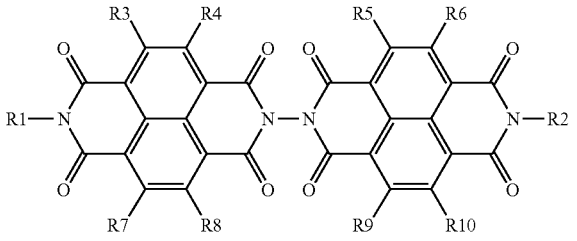

wherein R1 and R2 independently represent any one of a hydrogen atom, substituted or unsubstituted alkyl group, substituted or unsubstituted cycloalkyl group and substituted or unsubstituted aralkyl group, and R3, R4, R5, R6, R7, R8, R9 and R10 independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group.

The charge transporting material expressed by the General Formula (3) of the present invention has the following structural skeleton:

General Formula (3)

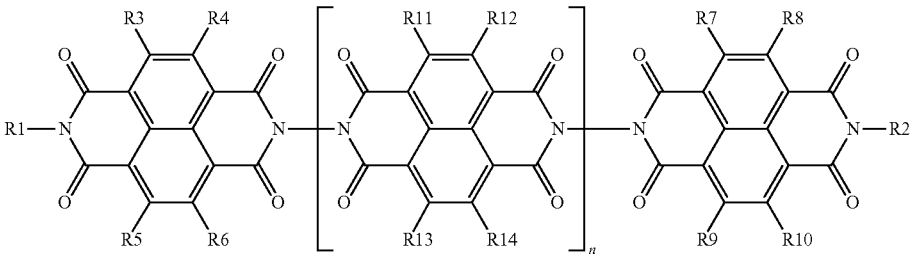

wherein R1 and R2 independently represent any one of a hydrogen atom, substituted or unsubstituted alkyl group, substituted or unsubstituted cycloalkyl group and substituted or unsubstituted aralkyl group, and R3, R4, R5, R6, R7, R8, R9, R10, R11, R12, R13 and R14 independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group, and "n" is a repeating unit and represents an integer of 0 to 100.

For the substituted or unsubstituted alkyl groups, alkyl groups of 1 to 25 carbon atoms, more preferably alkyl groups of 1 to 10 carbon atoms are used. Specific examples include straight-chain alkyl groups such as a methyl group, ethyl group, n-propyl group, n-butyl group, n-pentyl group, n-hexyl group, n-heptyl, n-octyl group, n-nonyl group and n-decyl group, branched-chain such as i-propyl group, s-butyl group, t-butyl group, methylpropyl group, dimethylpropyl group, ethylpropyl group, diethylpropyl group, methylbutyl group, dimethylbutyl group, methylpentyl group, dimethylpentyl group, methylhexyl group and dimethylhexyl group, and alkyl groups substituted with alkoxyalkyl group, monoalkylaminoalkyl group, dialkylaminoalkyl group, halogen-substituted alkyl group, alkylcarbonylalkyl group, carboxyalkyl group, alkanoyloxyalkyl group, aminoalkyl group, alkyl group substituted with carboxyl group that may be esterified and/or alkyl group substituted with cyano group. The positions of these substituents on alkyl carbon atoms are not particularly limited, and substituted or unsubstituted alkyl groups in which one or more of their carbon atoms are replaced by a hetero atom (e.g., N, O, or S) are also included as the substituted alkyl groups.

Examples of the substituted or unsubstituted cycloalkyl groups include cycloalkyls of 3 to 25 carbon atoms, more preferably, cycloalkyls of 3 to 10 carbon atoms are used. Specific examples thereof include cyclopropane, cyclobutane, cyclopentane, cyclohexane, cycloheptane, cyclooctane, cyclononane, cyclodecane, alkyl-substituted cycloalkyls such as methylcyclopentane, dimethylcyclopentane, methylcyclohexane, dimethylcyclohexane, trimethylcyclohexane, tetramethylcyclohexane, ethylcyclohexane, diethylcyclohexane and t-butylcyclohexane, cycloalkyls substituted with an alkoxylalkyl group, monoalkylaminoalkyl group, dialkylaminoalkyl group, halogen-substituted alkyl group, alkoxycarbonylalkyl group, carboxyalkyl group, alkanoyloxyalkyl group, aminoalkyl group, halogen atom, amino group, carboxyl group that may be esterified, and a cyano group. The positions of these substituents on cycloalkyl carbon atoms are not particularly limited, and substituted or unsubstituted cycloalkyl groups in which one or more of their carbon atoms are replaced by a hetero atom (e.g., N, O, or S) are also included as the substituted cycloalkyls.

Examples of the substituted or unsubstituted aralkyl groups include the above-described substituted or unsubstituted alkyl groups that are substituted with an aromatic ring; aralkyl groups of 6 to 14 carbon atoms are preferable. Specific examples include a benzyl group, perfluorophenylethyl group, 1-phenylethyl group, 2-phenylethyl group, terphenylethyl group, dimethylphenylethyl group, diethylphenylethyl group, t-butylphenylethyl group, 3-phenylpropyl group, 4-phenylbutyl group, 5-phenylpentyl group, 6-phenylhexyl group, benzhydryl group, and trityl group.

Examples of the halogen atoms include a fluorine atom, chlorine atom, bromine atom, and iodine atom.

For the method of producing a starting material of the electron transporting material expressed by the General Formula (1), the following methods can be exemplified. A naphthalenecarboxylic acid is synthesized by the following reaction formula according to the known synthesis method (for example, U.S. Pat. No. 6,794,102, Industrial Organic Pigments 2nd edition, VCH, 485 (1997) etc.):

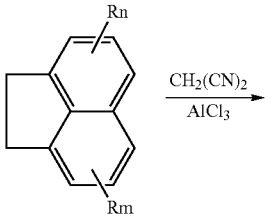

-continued

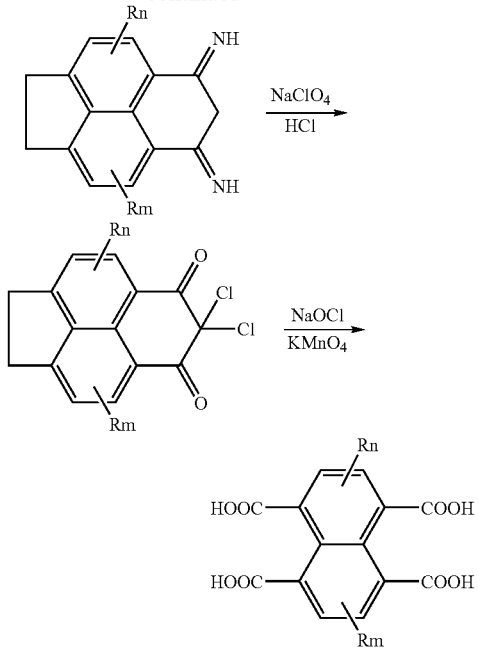

wherein Rn represents R3, R4, R5 and R6, and Rm represents R7, R8, R9 and R10.

The electron transporting material expressed by the General Formula (3) are mainly synthesized by the following two synthesis methods.

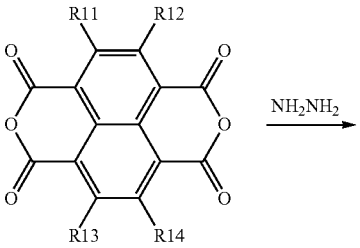

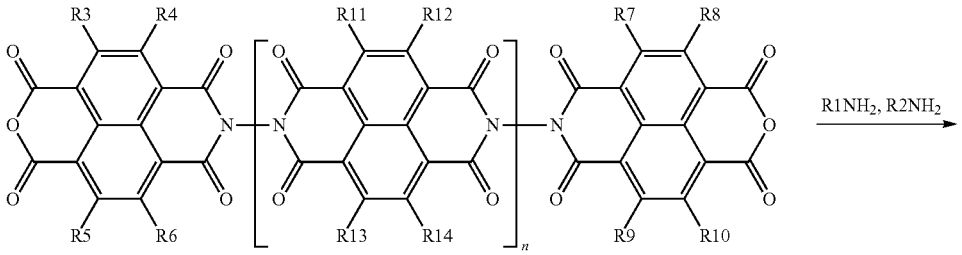

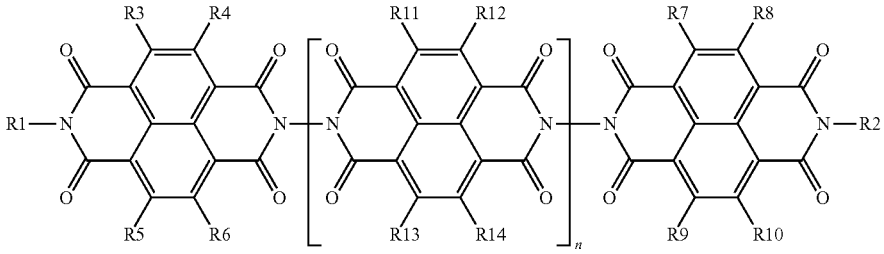

-continued

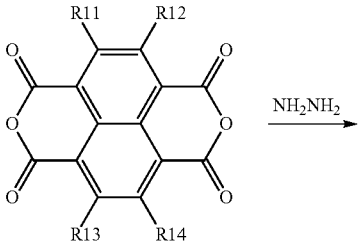

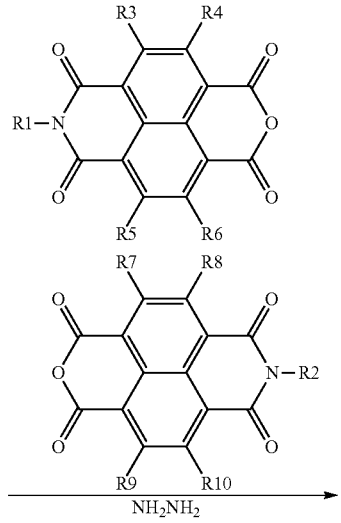

For the method of producing the starting material of the electron transporting material expressed by the General Formula (3), the following methods can be exemplified. A method in which naphthalenecarboxylic acid is synthesized by the following reaction formula according to the known synthesis method (for example, U.S. Pat. No. 6,794,102, Industrial Organic Pigments 2nd edition, VCH, 485 (1997) etc.):

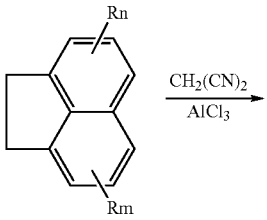

-continued

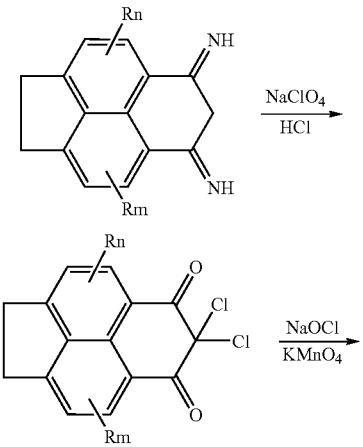

-continued

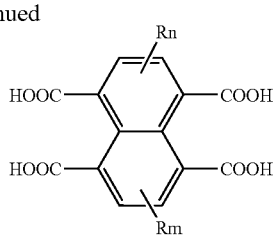

wherein Rn represents R3, R4, R7 and R8, and Rm represents R5, R6, R9 and R10.

The electron transporting material expressed by the General Formulas (1) and (3) of the invention is obtained by a method in which naphthalenecarboxylic acid or anhydride thereof is allowed to react with an amine to produce a monoimide; and a method in which naphthalenecarboxylic acid or anhydride is allowed to react with a diamine after adjustment of pH by adding a buffer. Mono-imidization is carried out in the presence or absence of a solvent. The solvent is not particularly limited, but the solvents which do not react with reactants and products and can react at 50° C. to 250° C. are suitably used. Examples of reactants include benzene, toluene, xylene, chloronaphthalene, acetic acid, pyridine, methylpyridine, dimethylformamide, dimethylacetoamide, dimethylethyleneurea and dimethylsulfoxide. For pH adjustment, a buffer obtained by mixing a basic aqueous solution e.g., lithium hydroxide or potassium hydroxide aqueous solution with an acid such as phosphoric acid. Dehydration of a carboxylic acid derivative which is prepared by reaction of a carboxylic acid with an amine or diamine is carried out in the presence or absence of a solvent. The solvent is not particularly limited, but a solvent which does not react with reactants and products and can react at 50° C. to 250° C. is suitably used. Examples of reactants include benzene, toluene, chloronaphthalene, bromonaphthalene, and acetic acid anhydride. Every reaction may be carried out in the presence or absence of catalyst. For example, molecular sieves, benzenesulfonic acid, p-toluenesulfonic acid or the like can be used as a dehydrating agent, but not limited thereto.

In the electron transporting material expressed by the General Formula (3), a repeating unit "n" represents an integer of 0 to 100. The repeating unit "n" is obtained by a mass average molecular mass (Mw). That is, the compound has a molecular mass distribution. When "n" is more than 100, the molecular mass of the compound becomes larger, and solubility to various solvents is reduced. Thus, the "n" is preferably 100 or less. Particularly, a dimmer in which "n" is 0 is preferred due to excellent solubility and photoconductor property.

On the other hand, for example, when "n" is 1, the electron transporting material is a trimer of naphthalenecarboxylic acid and by appropriately selecting substituents of "R1" and "R2" even the oligomer can obtain excellent electron transfer property. The naphthalenecarboxylic acid derivatives ranging broadly from an oligomer to a polymer are synthesized depending on the number of repeating unit "n".

In the range where molecular mass of the oligomer region is small, a monodisperse compound can be obtained by synthesizing in stages. A compound having a large molecular mass may obtain a compound having molecular mass distribution.

The hole transporting material expressed by the General Formula (2) of the invention has the following structural skeleton:

General Formula (2)

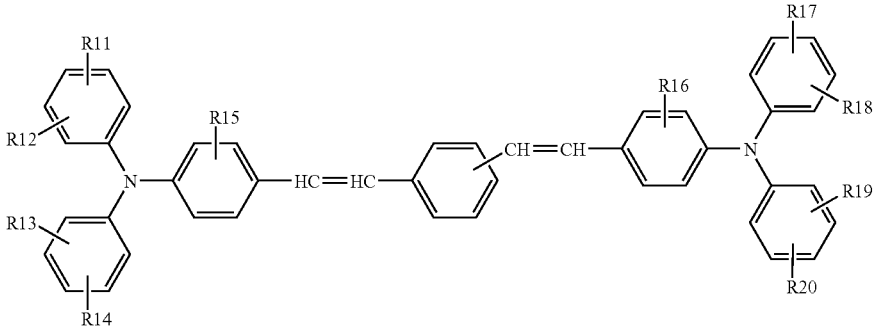

wherein R11, R12, R13, R14, R17, R18, R19 and R20 each represents a hydrogen atom, halogen atom, alkoxy group, alkyl group which may be substituted or aryl group which may be substituted, and R15 and R16 each represents a hydrogen atom, halogen atom, alkyl group, and alkoxy group.

Examples of the alkyl groups include chain alkyl groups such as a methyl group, ethyl group, propyl group, cyclic alkyl groups such as a cyclohexyl group, and cycloheptyl group.

Examples of the aryl groups include a phenyl group, naphthyl group, and anthryl group.

Examples of the halogen atoms include a fluorine atom, chlorine atom, and bromine atom.

Examples of the alkoxy group include a methoxy group, ethoxy group and propoxy group.

Examples of the substituents that each of the above group may have, include alkyl groups such as a methyl group, an ethyl group, a propyl group, a cyclohexyl group, and a cycloheptyl group; nitro groups; halogen atoms such as a fluorine atom, chlorine atom, bromine atom; halogenated alkyl groups such as perfluoroalkyl group; aryl groups such as phenyl group, naphthyl group, and anthryl group; aralkyl groups such as a benzyl group and phenethyl group; and alkoxy groups such as a methoxy group, ethoxy group, and propoxy group.

Preferred examples of the electron transporting material expressed by the General Formulas (1) and (3), and the hole transporting material expressed by the General Formula (2) are exemplified hereinbelow. However, the present invention is not limited to these compounds.

General Formula (1)
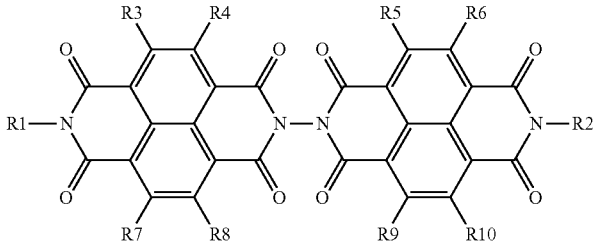
General Formula (3)
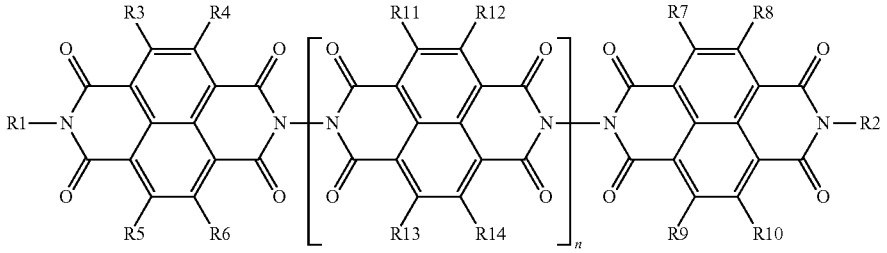
| No. | Structural Formula |
|---|---|
| 1-1 | 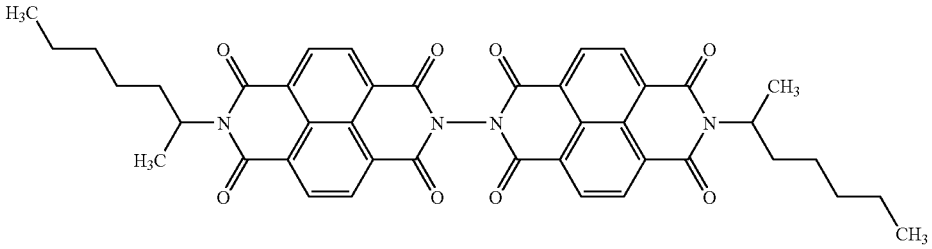 |
| 1-2 | 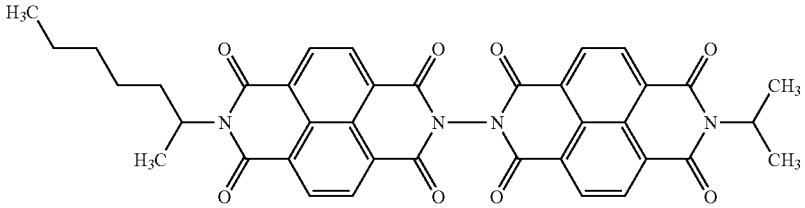 |
| 1-3 | 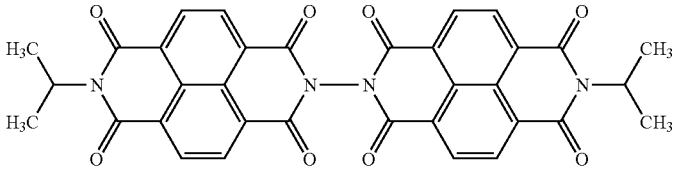 |
| 1-4 | 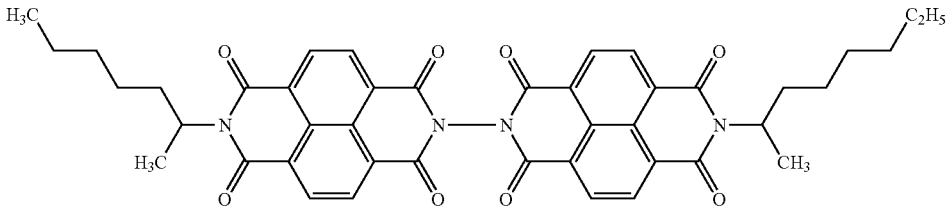 |

-continued
| No. | Structural Formula |
|---|---|
| 1-5 | 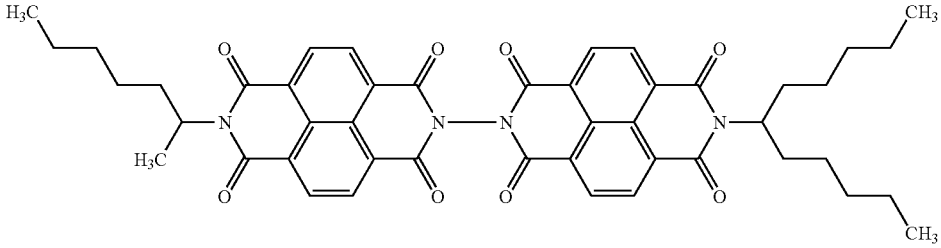 |
| 1-6 | 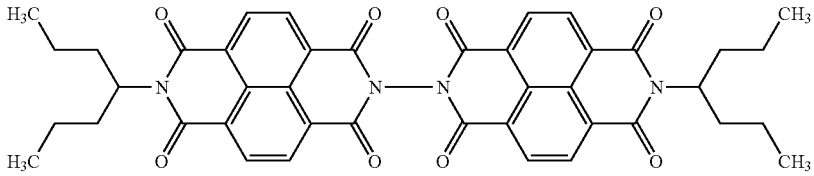 |
| 1-7 | 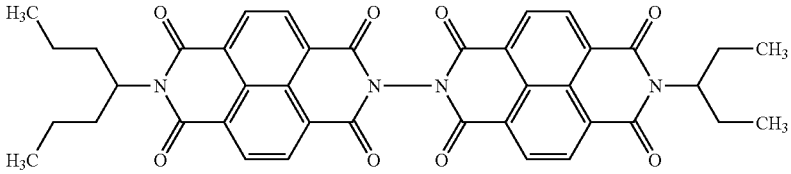 |
| 1-8 | 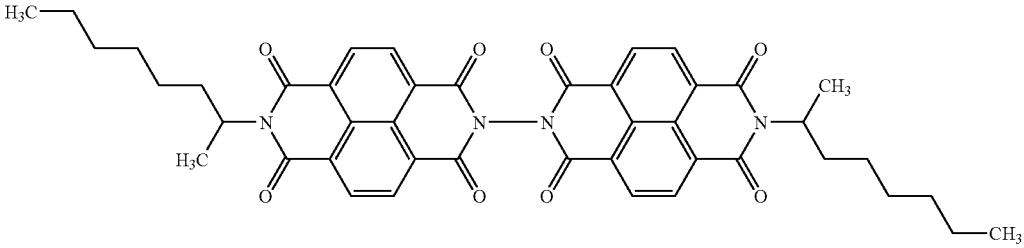 |
| 1-9 | 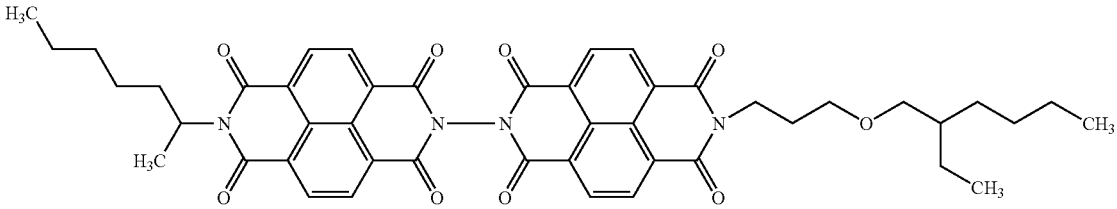 |
| 1-10 | 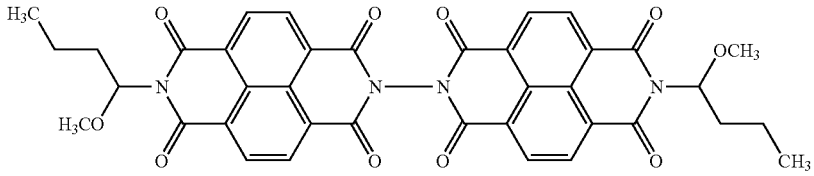 |
| 1-11 | 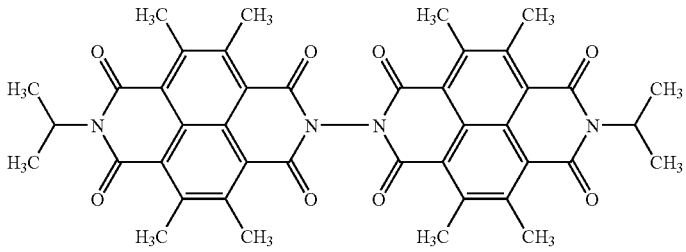 |

-continued

| No. | Structural Formula |
|---|---|
| 1-12 | 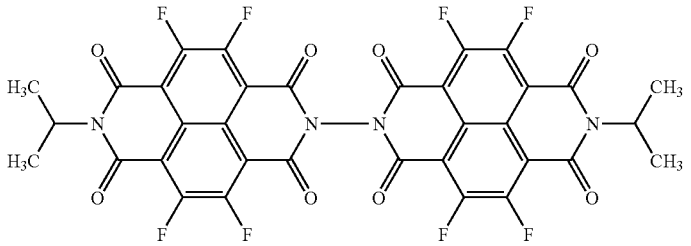 |
| 1-13 | 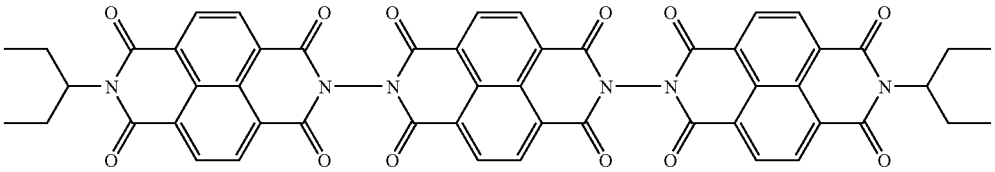 |
| 1-14 | 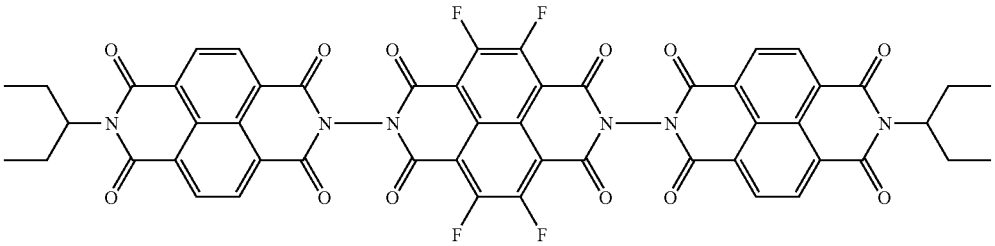 |

The electron transporting material expressed by the Structural Formula 1-1 is prepared by the following method.

<First Step>

To a 200 ml four-neck flask is added 5.0 g (18.6 mmol) of 1,4,5,8-naphthalenetetracarboxylic acid dianhydride and 50 ml of DMF, and heated to reflux. A mixture of 2.14 g (18.6 mmol) of 2-aminoheptane and 25 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography, and the recovered product is re-crystallized using toluene/hexane to produce 2.14 g of Monoimide A (yield of 31.5%).

<Second Step>

To a 100 ml four-necked flask is added 2.0 g (5.47 mmol) of Monoimide A, 0.137 g of (2.73 mmol) of hydrazine monohydrate, 10 mg of p-toluene sulfonic acid and 50 ml of toluene, and heated to reflux for 5 hours. Thereafter, the flask is cooled and the mixture is concentrated under vacuum. The resultant residue is purified by silica gel column chromatography, and the recovered product is re-crystallized using toluene/ethyl acetate to produce 0.668 g of the compound expressed by the Structural Formula 1-1 (yield of 33.7%). Identification of this product is made by Field Desorption Mass Spectroscopy (FD-MS), and it is identified that the product is the compound of interest on the basis of the peak observed at M/z of 726. Elemental analysis of this compound is as follows: carbon of 69.41%, hydrogen of 5.27%, nitrogen of 7.71% (calculated values) versus carbon of 69.52%, hydrogen of 5.09%, nitrogen of 7.93% (found values).

The electron transporting material expressed by the Structural Formula 1-2 is prepared by the following method.

<First Step>

To a 200 ml four-neck flask is added 10 g (37.3 mmol) of 1,4,5,8-naphthalentetracarboxylic acid dianhydride and 0.931 g of (18.6 mmol) of hydrazine monohydrate, 20 mg of p-toluene sulfonic acid, and 100 ml of toluene, and heated to reflux for 5 hours. Thereafter, the flask is cooled and the mixture is concentrated under vacuum. The resultant residue is purified by silica gel column chromatography, and the recovered product is re-crystallized using toluene/ethyl acetate to produce 2.84 g of Dimer C (yield of 28.7%).

<Second Step>

To a 100 ml four-necked flask is added 2.5 g (4.67 mmol) of Dimer C and 30 ml of DMF, and heated to reflux. A mixture of 0.278 g (4.67 mmol) of 2-aminopropane and 10 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography to produce 0.556 g of Monoimide C (yield of 38.5%).

<Third Step>

To a 50 ml four-necked flask is added 0.50 g (1.62 mmol) of Monoimide C and 10 ml of DMF, and heated to reflux. A mixture of 0.186 g (1.62 mmol) of 2-aminoheptane and 5 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography, and the recovered product is re-crystallized using toluene/hexane to produce 0.243 g of the compound expressed by the structural formula 1-2 (yield of 22.4%). Identification of this product is made by Field Desorption Mass Spectroscopy (FD-MS), and it is identified that the product is the compound of interest on the basis of the peak observed at M/z of 670. Elemental analysis of this compound is as follows: carbon of 68.05%, hydrogen of 4.51%, nitrogen of 8.35% (calculated values) versus carbon of 68.29%, hydrogen of 4.72%, nitrogen of 8.33% (found values).

The electron transporting material expressed by the Structural Formula 1-3 is prepared by the following method.

<First Step>

To a 200 ml four-neck flask is added 5.0 g (18.6 mmol) of 1,4,5,8-naphthalentetracarboxylic acid dianhydride and 50 ml of DMF, and heated to reflux. A mixture of 1.10 g (18.6 mmol) of 2-aminopropane and 25 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography, and the recovered product is re-crystallized using toluene/hexane to produce 2.08 g of Monoimide B (yield of 36.1%).

<Second Step>

To a 100 ml four-necked flask is added 2.0 g (6.47 mmol) of Monoimide B, 0.162 g of (3.23 mmol) of hydrazine monohydrate, 10 mg of p-toluene sulfonic acid, and 50 ml of toluene, and heated to reflux for 5 hours. Thereafter, the flask is cooled and the mixture is concentrated under vacuum. The resultant residue is purified by silica gel column chromatography, and the recovered product is re-crystallized using toluene/ethyl acetate to produce 0.810 g of the compound expressed by the Structural Formula 1-3 (yield of 37.4%). Identification of this product is made by Field Desorption Mass Spectroscopy (FD-MS), and it is identified that the product is the compound of interest on the basis of the peak observed at M/z of 614. Elemental analysis of this compound is as follows: carbon of 66.45%, hydrogen of 3.61%, nitrogen of 9.12% (calculated values) versus carbon of 66.28%, hydrogen of 3.45%, nitrogen of 9.33% (found values).

The electron transporting material expressed by the Structural Formula 1-4 is prepared by the following method.

<First Step>

To a 200 ml four-neck flask is added 5.0 g (9.39 mmol) of Dimer C and 50 ml of DMF, and heated to reflux. A mixture of 1.08 g (9.39 mmol) of 2-aminoheptane and 25 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography to produce 1.66 g of Monoimide D (yield of 28.1%).

<Second Step>

To a 100 ml four-necked flask is added 1.5 g (2.38 mmol) of Monoimide D and 50 ml of DMF, and heated to reflux. A mixture of 0.308 g (2.38 mmol) of 2-aminooctane and 10 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography, and the recovered product is re-crystallized using toluene/hexane to produce 0.328 g of the compound expressed by the Structural Formula 1-4 (yield of 18.6%). Identification of this product is made by Field Desorption Mass Spectroscopy (FD-MS), and it is identified that the product is the compound of interest on the basis of the peak observed at M/z of 740. Elemental analysis of this compound is as follows: carbon of 69.72%, hydrogen of 5.44%, nitrogen of 7.56% (calculated values) versus carbon of 69.55%, hydrogen of 5.26%, nitrogen of 7.33% (found values).

The electron transporting material expressed by the Structural Formula 1-5 is prepared by the following method.

<First Step>

To a 200 ml four-neck flask is added 5.0 g (9.39 mmol) of Dimer C and 50 ml of DMF, and heated to reflux. A mixture of 1.08 g (9.39 mmol) of 2-aminoheptane and 25 ml of DMF is then added dropwise to the flask with agitation, and heated to reflux for 6 hours. Thereafter, the flask is cooled and the mixture is concentrated under vacuum. The resultant residue is added with toluene and purified by silica gel column chromatography to produce 1.66 g of Monoimide D (yield of 28.1%).

<Second Step>

To a 100 ml four-necked flask is added 1.5 g (2.38 mmol) of Monoimide D and 50 ml of DMF, and heated to reflux. A mixture of 0.408 g (2.38 mmol) of 6-aminoundecane and 10 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography, and the recovered product is re-crystallized using toluene/hexane to produce 0.276 g of the electron transporting material expressed by the Structural Formula 1-5 (yield of 14.8%). Identification of this product is made by Field Desorption Mass Spectroscopy (FD-MS), and it is identified that the product is the compound of interest on the basis of the peak observed at M/z of 782. Elemental analysis of this compound is as follows: carbon of 70.57%, hydrogen of 5.92%, nitrogen of 7.16% (calculated values) versus carbon of 70.77%, hydrogen of 6.11%, nitrogen of 7.02% (found values).

The electron transporting material expressed by the Structural Formula 1-13 is prepared by the following method.

<First Step>

To a 200 ml four-neck flask is added 5.0 g (18.6 mmol) of 1,4,5,8-naphthalentetracarboxylic acid dianhydride and 50 ml of DMF, and heated to reflux. A mixture of 1.62 g (18.6 mmol) of 2-aminopentane and 25 ml of DMF is then added dropwise to the flask with agitation, and then heated to reflux for 6 hours. Thereafter, the flask is cooled and the mixture is concentrated under vacuum. The resultant residue is added with toluene and purified by silica gel column chromatography, and the recovered product is re-crystallized using toluene/hexane to produce 3.49 g of Monoimide E (yield of 45.8%).

<Second Step>

To a 100 ml four-necked flask is added 3.0 g (7.33 mmol) of Monoimide E, 0.983 g (3.66 mmol) of 1,4,5,8-naphthalentetracarboxylic acid dianhydride, 0.368 g (7.33 mmol) of hydrazine monohydrate, 10 mg of p-toluene sulfonic acid and 50 ml of toluene, and heated to reflux for 5 hours. Thereafter, the flask is cooled and the mixture is concentrated under vacuum. The resultant residue is purified by silica gel column chromatography twice, and the recovered product is re-crystallized using toluene/ethyl acetate to produce 0.939 g of the electron transporting material expressed by the Structural Formula 1-13 (yield of 13.7%). Identification of this product is made by Field Desorption Mass Spectroscopy (FD-MS), and it is identified that the product is the compound of interest on the basis of the peak observed at M/z of 934. Elemental analysis of this compound is as follows: carbon of 66.81%, hydrogen of 3.67%, nitrogen of 8.99% (calculated values) versus carbon of 66.92%, hydrogen of 3.74%, nitrogen of 9.05% (found values).

General Formula (2)
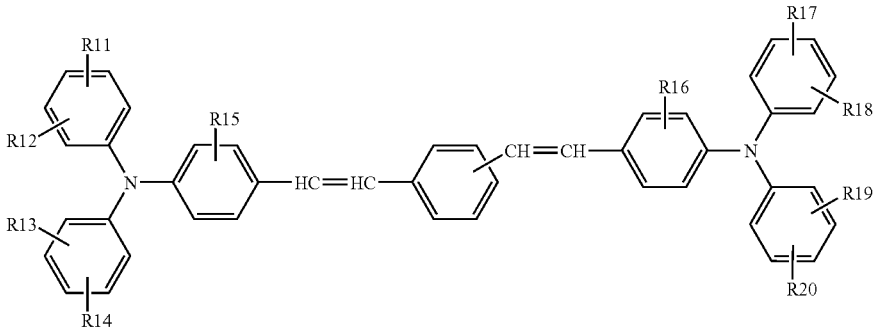
| No. | Structural Formula |
|---|---|
| 2-1 | 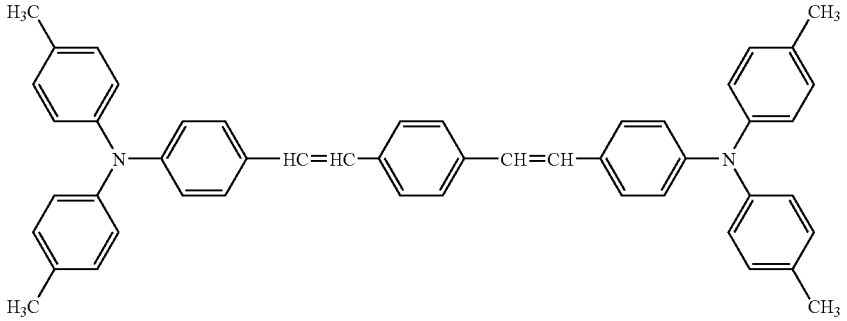 |
| 2-2 | 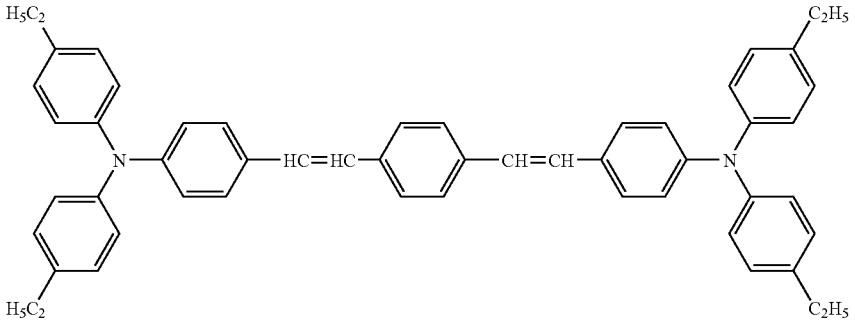 |
| 2-3 | 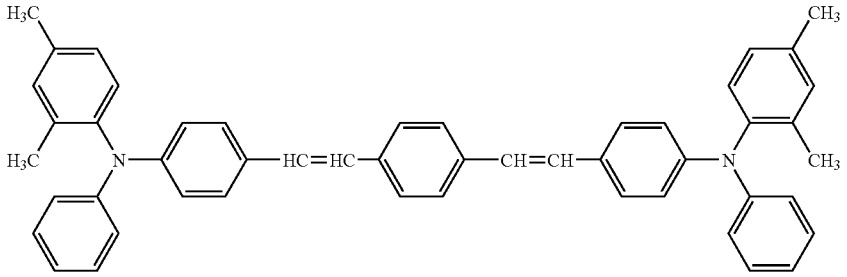 |

-continued
| No. | Structural Formula |
|---|---|
| 2-4 | 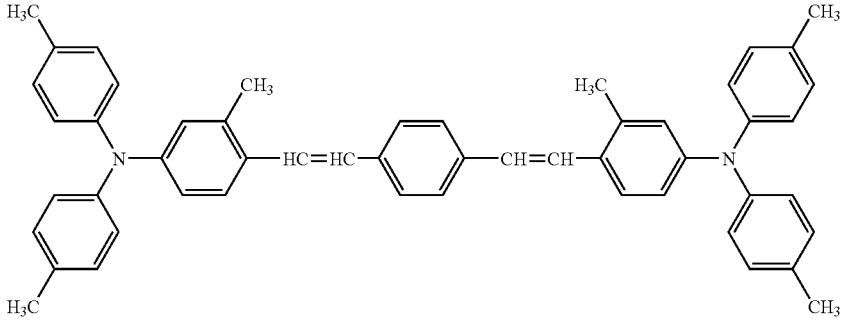 |
| 2-5 | 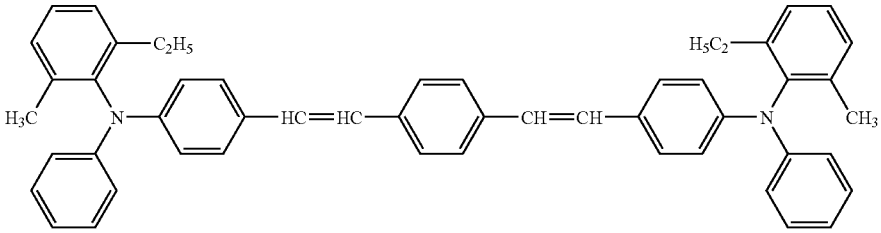 |
| 2-6 | 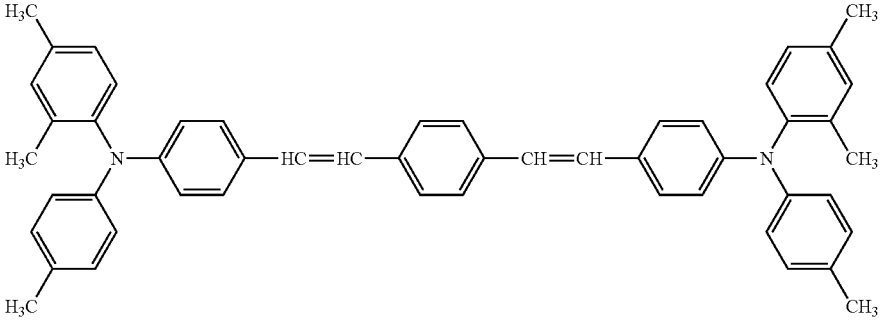 |
| 2-7 | 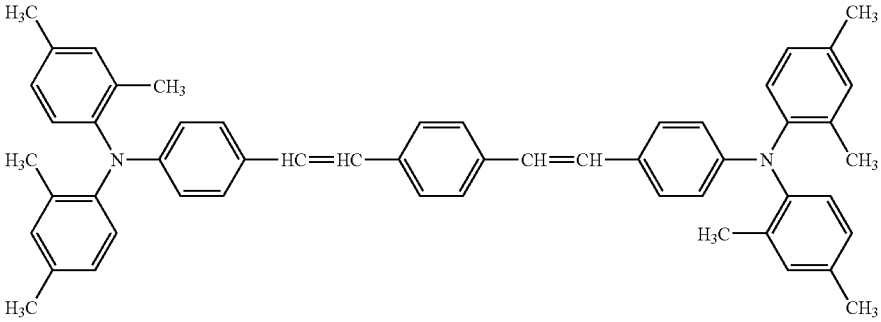 |
| 2-8 | 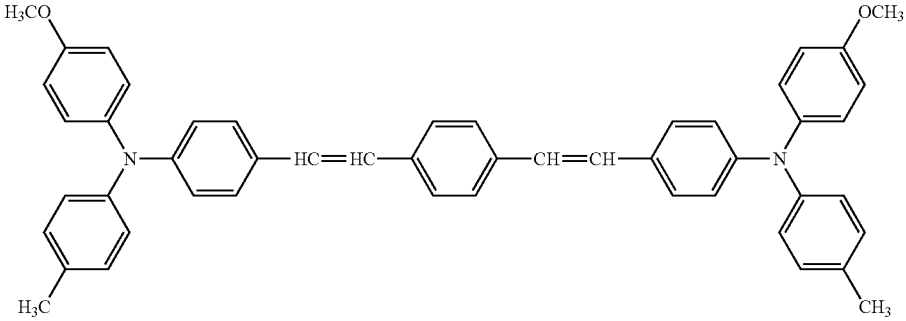 |

-continued
| No. | Structural Formula |
|---|---|
| 2-9 | 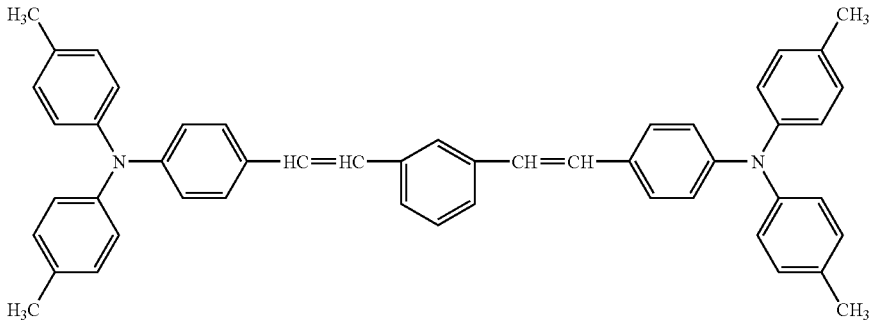 |
| 2-10 | 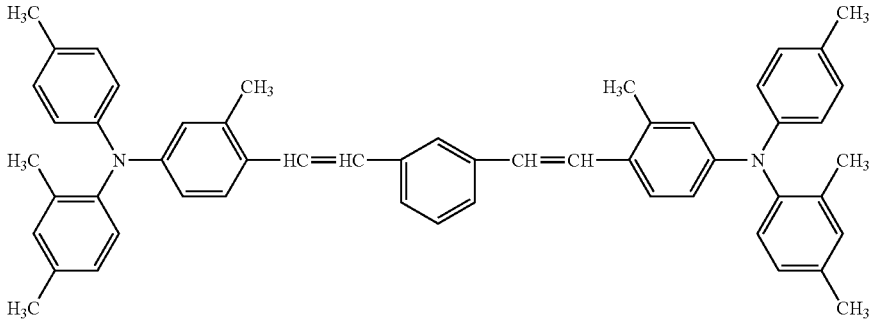 |
| 2-11 | 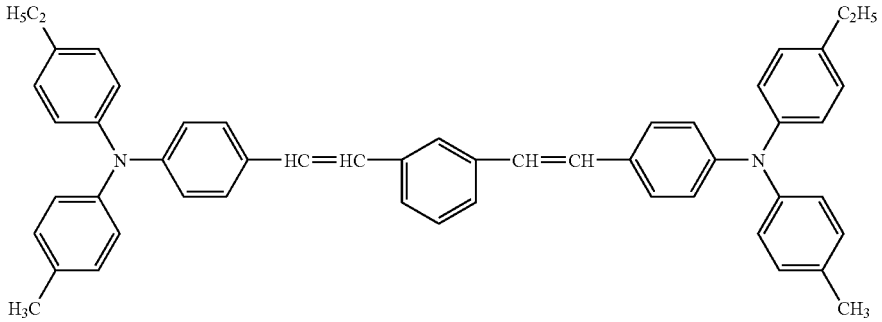 |
| 2-12 | 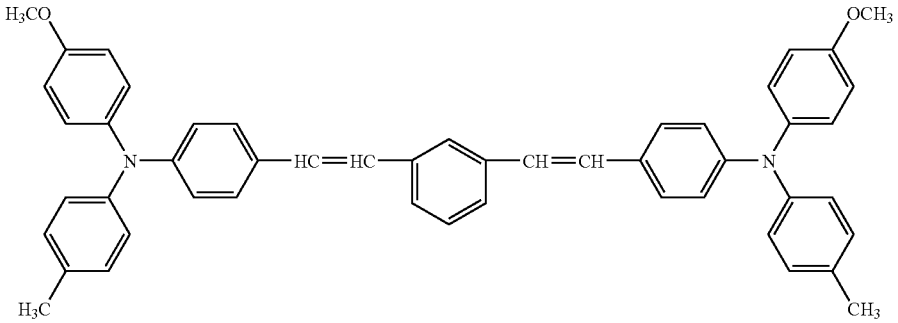 |

-continued

| No. | Structural Formula |
|---|---|
| 2-13 | 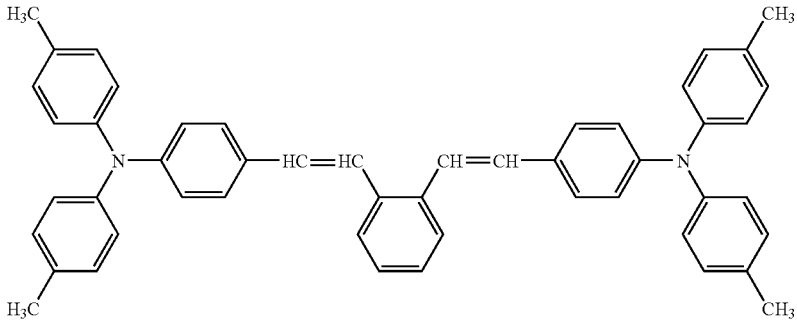 |
| 2-14 | 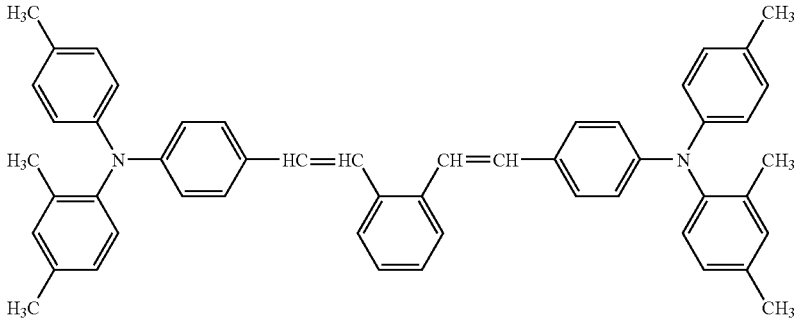 |
| 2-15 | 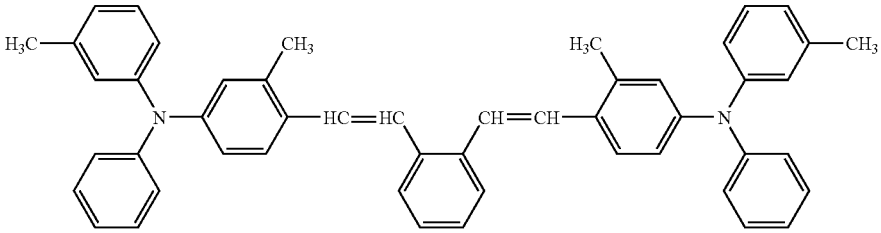 |

Next, the organic sulfur antioxidant will be explained.

The organic sulfur antioxidant of the present invention is not particularly limited and can be selected from the known various antioxidants as long as it is an antioxidant including a sulfur atom. Particularly, the compound expressed by the General Formula (4) is preferably used because increase of residual potential and reduction of sensitivity may hardly occur. This may be because the compound expressed by the General Formula (4) is appropriately soluble in the photosensitive layer due to the compound having an ester group. In the compound expressed by the General Formula (4), when "n" is less than 8, the compound easily sublimes. When "n" is more than 25, the compound is less soluble in the photosensitive layer and may be separated out.

The organic sulfur antioxidants are specifically exemplified hereinbelow, but the present invention is not limited thereto.

| No. | Structural Formula |
|---|---|
| 3-1 | $S—(CH_2CH_2COOC_8H_{17})_2$ |
| 3-2 | $S—(CH_2CH_2COOC_{12}H_{25})_2$ |
| 3-3 | $S—(CH_2CH_2COOC_{13}H_{27})_2$ |
| 3-4 | $S—(CH_2CH_2COOC_{14}H_{29})_2$ |
| 3-5 | $S—(CH_2CH_2COOC_{18}H_{37})_2$ |
| 3-6 | $S—(CH_2CH_2COOC_{22}H_{45})_2$ |

-continued

| No. | Structural Formula |
|---|---|
| 4-1 | 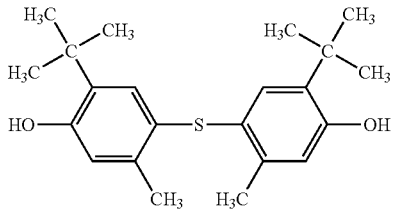 |
| 4-2 | 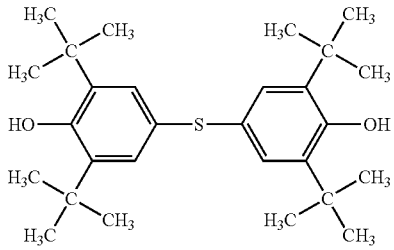 |

-continued

| No. | Structural Formula |
|---|---|
| 4-3 | 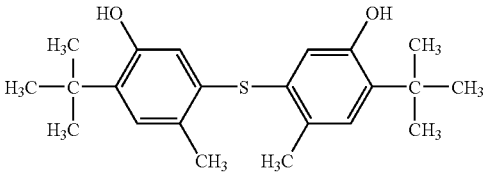 |

In the invention, either the electron transporting material expressed by the General Formula (1) and the hole transporting material expressed by the General Formula (2) or the electron transporting material expressed by the General Formula (3) as a charge transporting material must be contained in the photosensitive layer, and additionally the known charge transporting material, that is, the electron transporting material and the hole transporting material may be further contained together.

Examples of the electron transporting materials include electron-accepting substances such as chloranile, bromanile, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one and 1,3,7-trinitrodibenzothiophene-5,5-dioxide. These electron transporting material may be used alone or in a mixture.

As the hole transporting material, electron-donating substances may be preferably used.

Examples thereof include oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazones, α-phenyl stilbene derivatives, thiazole derivatives, triazole derivatives, phenazine derivatives, acridine derivatives, benzofuran derivatives, benzimidazole derivatives and thiophene derivatives.

These hole transporting materials may be used alone or in a mixture.

A high-molecular compound used for a binder component of the photosensitive layer can be selected from the known high-molecular compounds. Examples thereof include thermoplastic resins and thermosetting resins such as polystyrenes, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylate resins, polycarbonate resins, cellulose acetate resins, ethylcellulose resins, polyvinyl butyrals, polyvinyl formals, polyvinyl toluene, acrylic resins, silicone resins, fluorine resins, epoxy resins, melamine resins, urethane resins, phenol resins, and alkyd resins, but not limited thereto.

Among these high-molecular compound, the polycarbonate resins are particularly preferred in terms of film quality.

As the methods for forming the photosensitive layer a casting method from solution dispersal system is preferred. The photosensitive layer is disposed by the casting method in a manner that the charge generating material, charge transporting material, the binder resin, and further other components as necessary are dissolved and/or dispersed in an appropriate solvent to prepare a coating liquid, and the coating liquid is adjusted in an appropriate density and coated to form the photosensitive layer.

In order to uniformly disperse the charge generating material in the photosensitive layer (in the coating liquid), it is preferred that a dispersion liquid is prepared beforehand by dispersing the charge generating material with a solvent such as tetrahydrofuran, cyclohexanone, dioxane, dichloroethane, butanone, as well as a binder resin if necessary, using a ball mill, Attritor or sand mill.

Examples of the casting methods include dip-coating, spray coating and bead coating.

Examples of the dispersion solvent used to prepare the coating liquid for the photosensitive layer as described above include ketones such as methyl ethyl ketone, acetone, methyl isobutyl ketone and cyclohexanone; ethers such as dioxane, tetrahydrofuran, and ethylcellosolve; aromatic compounds such as toluene and xylene; halogen compounds such as chlorobenzene and dichloromethane; esters such as ethyl acetate and butyl acetate. These solvents may be used alone or in a mixture.

The content of the charge generating material is 0.1% by mass to 30% by mass, preferably 0.5% by mass to 10% by mass on the basis of the entire photosensitive layer. The content of the electron transporting material is 5 parts by mass to 300 parts by mass, preferably 10 parts by mass to 150 parts by mass on the basis of 100 parts by mass of the binder resin component. However, the electron transporting material expressed by the General Formula (1) is preferably 50% by mass to 100% by mass on the basis of the entire electron transporting material. The hole transporting material is 5 parts by mass to 300 parts by mass, preferably 20 parts by mass to 150 parts by mass on the basis of 100 parts by mass of the binder resin component. However, the hole transporting material expressed by the General Formula (2) is preferably 50% by mass to 100% by mass on the basis of the entire hole transporting material. The total amount of the electron transporting material and the hole transporting material is 20 parts by mass to 300 parts by mass, preferably 30 parts by mass to 200 parts by mass on the basis of 100 parts by mass of the binder resin component.

The content of the organic sulfur antioxidant is 0.05% by mass to 5% by mass, preferably 0.1% by mass to 1% by mass on the basis of the entire photosensitive layer.

Low molecular compounds such as an antioxidant, a plasticizer, a lubricant, and a UV absorbent; and a leveling agent may be added in the photosensitive layer as necessary. These compounds are used alone or in a mixture. The content of the low molecular compounds is 0.1 parts by mass to 50 parts by mass, preferably 0.1 parts by mass to 20 parts by mass on the basis of 100 parts by mass of the binder resin. The content of the leveling agent is appropriately 0.001 parts by mass to 5 parts by mass on the basis of 100 parts by mass of the binder resin.

The thickness of the photosensitive layer is appropriately 5 μm to 40 μm, and preferably 15 μm to 35 μm.

Figure 8:
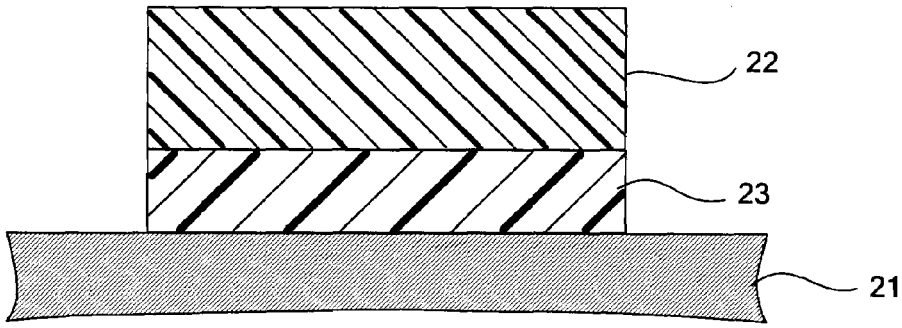
FIG. 8 is a cross-sectional view showing an another example of a layer composition of an electrophotographic photoconductor of the present invention.

As shown in FIG. 8, the electrophotographic photoconductor of the invention, an undercoat layer 23 may be disposed between a conductive substrate 21 and a photosensitive layer 22. The undercoat layer is disposed for the purpose of improvement of adhesive property, modification of coating property of an upper layer, reduction of residual potential, and prevention of charge injection from the conductive substrate.

In general, the undercoat layer is primarily composed of resin. In view of the fact that the solvent for the photosensitive layer is applied on the resin, the resin is preferably selected from those that are less soluble in general organic solvents. Examples of such resin are curable resins that form three-dimensional networks upon cured, including water-soluble resins such as polyvinyl alcohol, casein and sodium polyacrylate, alcohol-soluble resins such as a copolymer nylons and methoxymethylated nylon, polyurethane resins, melamine resins, alkyd-melamine resins, and epoxy resins.

In addition, fine powder pigments obtained from metal oxides such as titanium oxide, silica, alumina, zirconium oxide, tin oxide and indium oxide, metal sulfide, and metal nitride may also be added to the undercoat layer.

These undercoat layers are formed by an appropriate solvent and coating method the same as the photosensitive layer.

Furthermore, a metal oxide layer, which is formed using silane coupling agents, titanium coupling agents, and chrome coupling agents by sol-gel method, is also useful for the undercoat layer. The undercoat layer of anodized $Al_2O_3$, and the undercoat layer disposed by vacuum deposition of organic compounds such as polyparaxylylene (parylene) and inorganic compounds such as $SiO_2$, $SnO_2$, $TiO_2$, ITO and $CeO_2$ may be preferably used.

The thickness of the undercoat layer is appropriately 0.1 μm to 10 μm, and preferably 1 μm to 5 μm.

In the invention, an antioxidant, a plasticizer, a UV absorbent, and a leveling agent can be added in the photosensitive layer for the purpose of the improvement of gas barrier and environmental resistance.

Next, the image forming apparatus of the invention will be explained hereinbelow.

Figure 1:
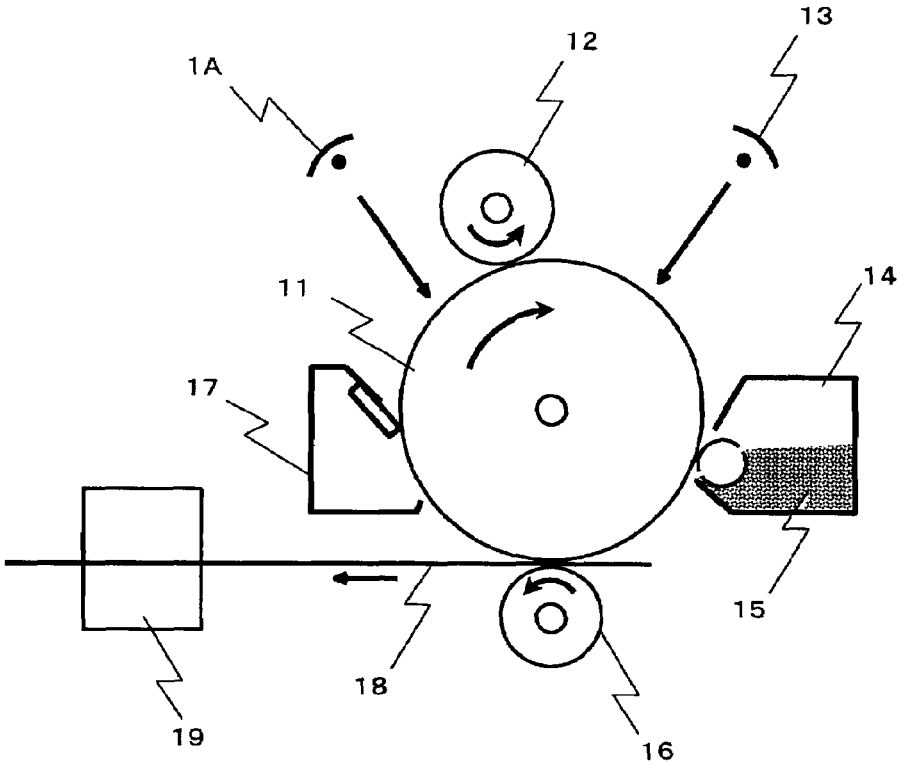
FIG. 1 is a schematic cross-sectional view showing an example of an image forming apparatus of the present invention.

FIG. 1 is a cross-sectional view illustrating an example of an image forming apparatus of the present invention, and modified examples described hereinbelow also belong to the scope of the present invention.

In FIG. 1, a photoconductor 11 is a photoconductor which satisfies the requirement of the present invention. The photoconductor 11 has a drum-like shape, however, it may be a sheet-like shape or endless belt-like shape.

As a charging unit 12, the known chargers as a corotron, a scorotron, a solid state charger, and a charging roller are used. The charging unit 12 which is in contact with or adjacently disposed to the photoconductor is preferably used from the viewpoint of reduction of power consumption. Of these, to prevent the contamination of the charging unit 12, the charging mechanism is preferably configured such that the charging unit 12 is adjacently arranged near the photoconductor so as to provide an appropriate gap between the photoconductor and the surface of the charging unit.

In the invention, either negative or positive charge polarity can be used. However, the positive charge is preferred due to the stable charge property and the small amount of generated ozone, as compared to the negative charge.

The above charging device can be generally used for a transferring unit 16, however, the combination of a transfer charger and separation charger is effective.

As light sources for a charging unit 13, a charge removing unit 1A and the like, general light emitting sources can be employed. Examples thereof include fluorescent lamps, tungsten lamps, halogen lamps, mercury vapor lamps, sodium lamps, light emitting diodes (LED), semiconductor lasers (LD), electroluminescence (EL) and the like. For a light source to emit light of desired wavelength, various filters such as a sharp cut filter, band pass filter, near infrared cut filter, dichroic filer, interference filter, and color temperature conversion can be used.

A toner 15 which has been developed on the photoconductor by means of a developing unit 14 is transferred to a image receiving medium 18. At this point, not all toner particles are transferred to the image receiving medium 18, but some remain on the photoconductor. The toner particles remained on the photoconductor are removed from the photoconductor by means of a cleaning unit 17. As the cleaning unit, rubber cleaning blades, and brushes including a fur brush and a magnetic fur brush may be used.

Figure 2:
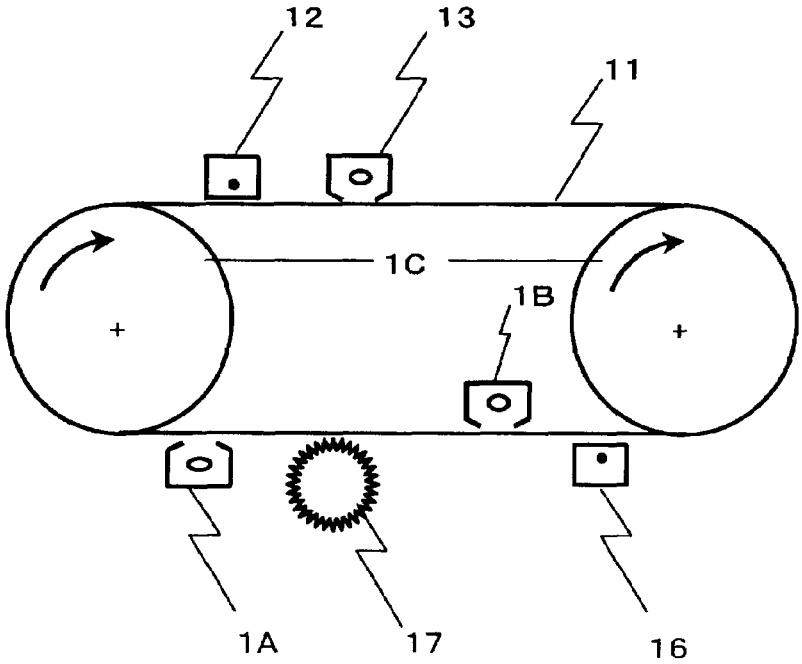
FIG. 2 is a schematic cross-sectional view showing an another example of an image forming apparatus of the present invention.

FIG. 2 shows another example of the image forming apparatus of the present invention. In FIG. 2, a photoconductor 11 satisfies a requirements of the invention, and is endless belt-like shape. Driven by driving unit 1C, a charging step, an exposing step, a developing step (not shown), a transferring step, a pre-cleaning exposing step, a cleaning step, and a charge removing step are carried out repeatedly by means of a charging unit 12, an exposing unit 13, a transferring unit 16, a pre-cleaning exposing unit 1B, a cleaning unit 17 and a charge removing unit 1A, respectively. In FIG. 2, the light is irradiated from the substrate side of the photoconductor, which is translucent in this case, for pre-cleaning exposing.

The image forming apparatus thus described is just an exemplification of the embodiment of the present invention. It is, of course, possible to adopt another embodiment. For example, although pre-cleaning exposing is carried out from the substrate side in FIG. 2, this may be carried out from the photosensitive layer side. In addition, image exposing and charge removing light may be irradiated from the substrate side. The image exposing step, pre-cleaning exposing step, and charge removing exposing step are shown as exposing steps, however, a pre-transferring exposing step, a pre-image exposing step, and several other known exposing steps may be carried out to the photoconductor.

Figure 3:
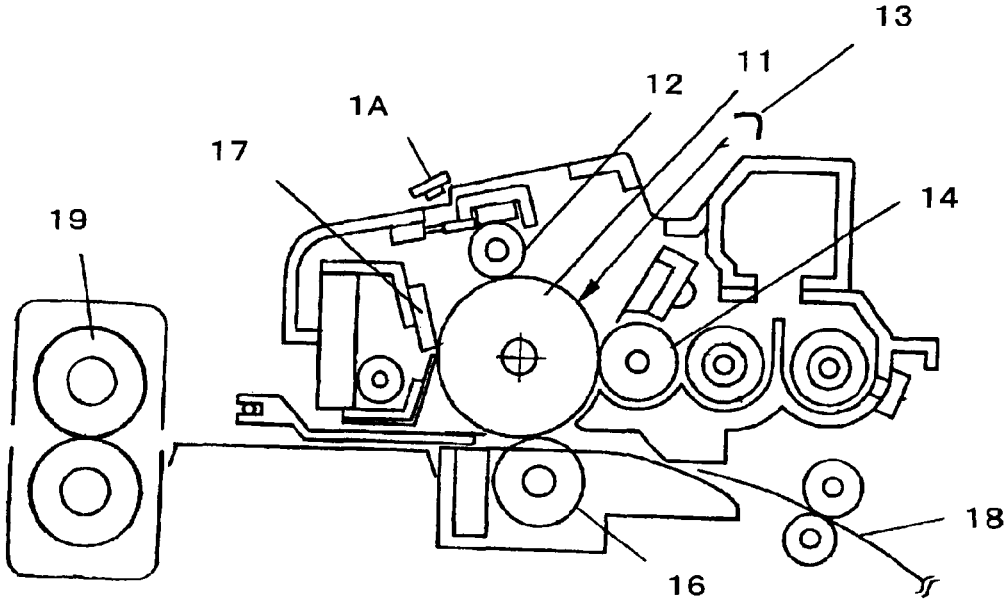
FIG. 3 is a schematic cross-sectional view showing an example of a process cartridge of the present invention.

The image forming units described above may be fixed inside a copier, a facsimile, or a printer, however, the image forming unit may be contained in such a device in a form of a process cartridge. "Process cartridge" is a single device or component which contains a photoconductor therein and includes one or two or more of other units such as a charging unit, an exposing unit, a developing unit, a transferring unit, a cleaning unit, a charge removing unit, and the like. There are may shapes of process cartridges, and FIG. 3 shows an example of a commonly used one. In this embodiment, the photoconductor 11 also satisfies the requirement of the invention. The photoconductor 11 is a drum-like shape, but it may be a sheet-like shape or endless belt-like shape.

Figure 4:
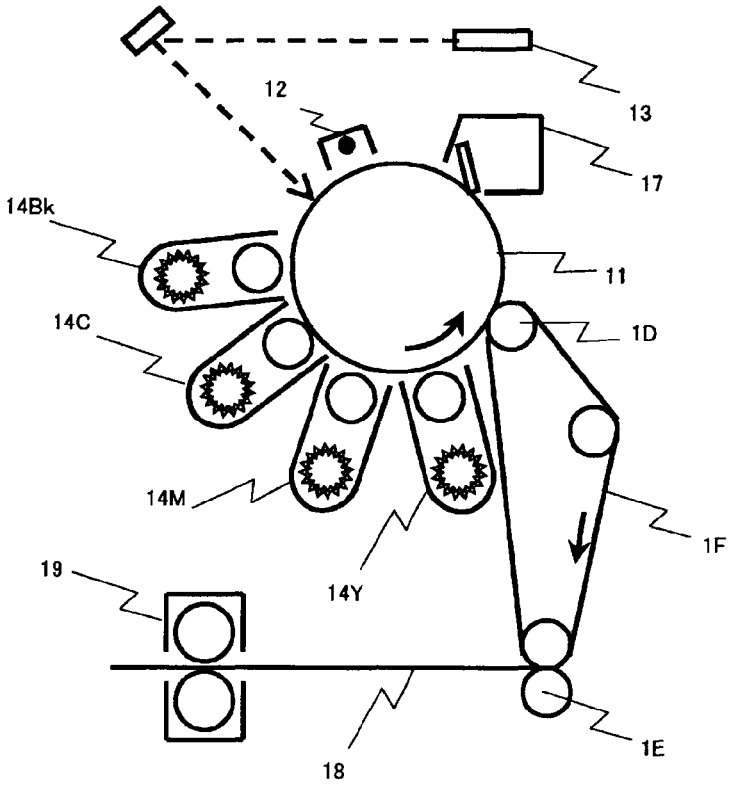
FIG. 4 is a schematic cross-sectional view showing an another example of an image forming apparatus of the present invention.

FIG. 4 is an example of a full-color image forming apparatus of the present invention. In this image forming apparatus, a charging unit (charging device) 12, an exposing unit 13, developing units 14Bk, 14C, 14M and 14Y of respective toners of black (Bk), cyan (C), magenta (M) and yellow (Y), an intermediate transfer belt 1F as an intermediate transfer medium and a cleaning unit 17 are arranged in this order around the photoconductor 11. The characters Bk, C, M and Y correspond to the colors of the toners, and characters are added or omitted accordingly.

The photoconductor 11 is an electrophotographic photoconductor which satisfies the requirement of the present invention. The developing units of each color, 14Bk, 14C, 14M and 14Y can be controlled independently and only the developing unit of which the color is used for forming an image is activated. The toner image formed on the photoconductor 11 is transferred to the intermediate transfer belt 1F by means of the primary transfer unit 1D located inside of the intermediate transfer belt 1F. The primary transfer unit 1D is disposed so as to be in contact or noncontact with the photoconductor 11 and the intermediate transfer belt 1F comes in contact with the photoconductor 11 only at the time of transferring. The image of each color is formed sequentially and the toner images superimposed on the intermediate transfer belt 1F are transferred to an image receiving medium 18 at once by means of the secondary transfer unit 1E and then fixed by means of a fixing unit 19 to form an image. The secondary transfer unit 1E is also disposed so as to be in contact or noncontact with the intermediate transfer belt 1F and it comes in contact with the intermediate transfer belt 1F only at the time of transferring.

In an image forming apparatus of transfer drum system, a toner image of each color is sequentially transferred on a transfer material which is electrostatically adsorbed to the transfer drum. Thus, the transfer material is limited to use in the transfer drum system, for example, the toner image cannot print on a cardboard. However, as shown in FIG. 4, in an image forming apparatus of intermediate transfer system, a toner image of each color is superimposed on the intermediate transfer medium (1F). Therefore, the transfer material is not limited to use in the intermediate transfer system. The intermediate transfer system may be applied not only in the image forming apparatus shown in FIG. 4, but also in the image forming apparatuses shown in FIGS. 1, 2, 3 and 5 (a specific example is shown in FIG. 6).

Figure 5:
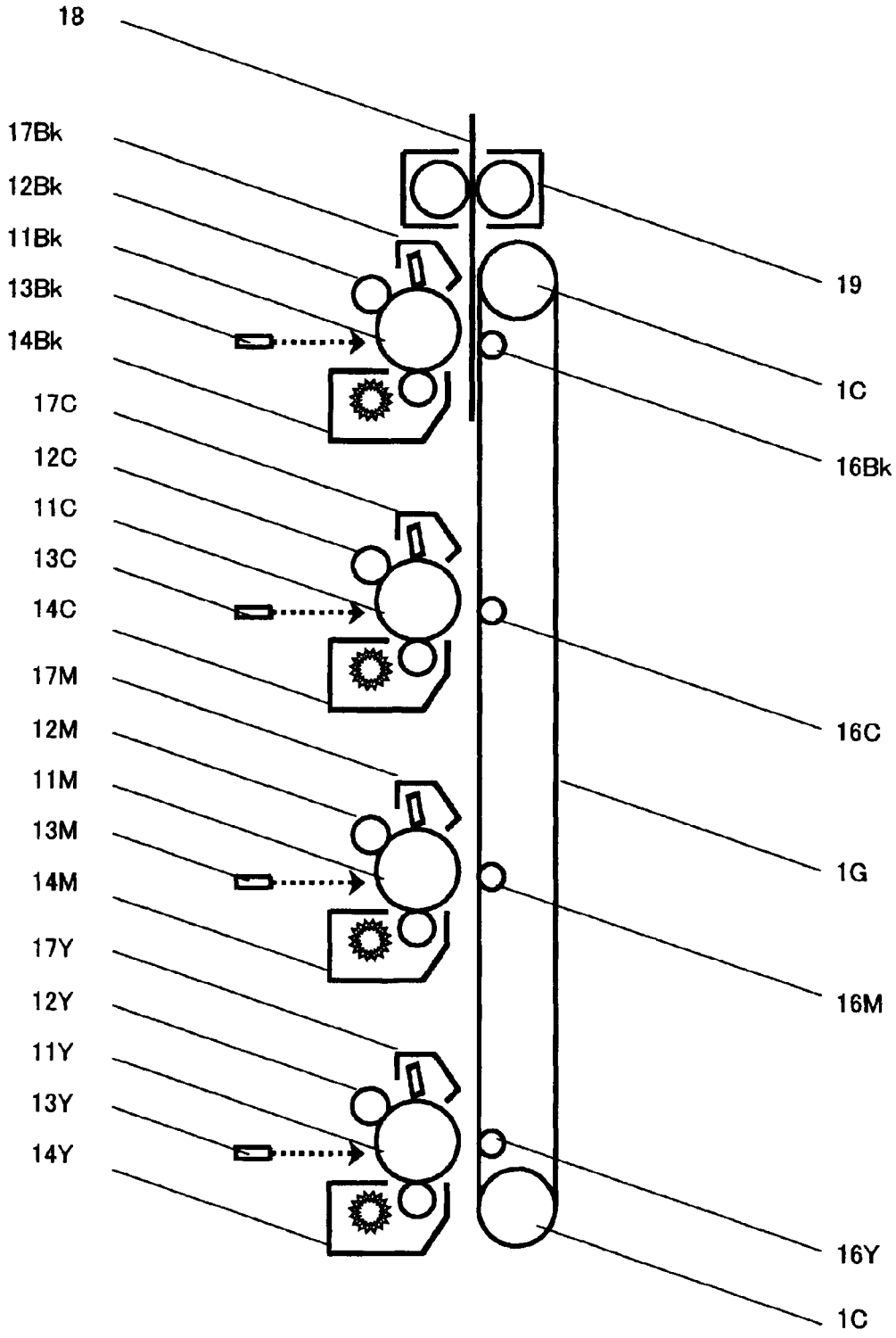
FIG. 5 is a schematic cross-sectional view showing a still another example of an image forming apparatus of the present invention.
Figure 6:
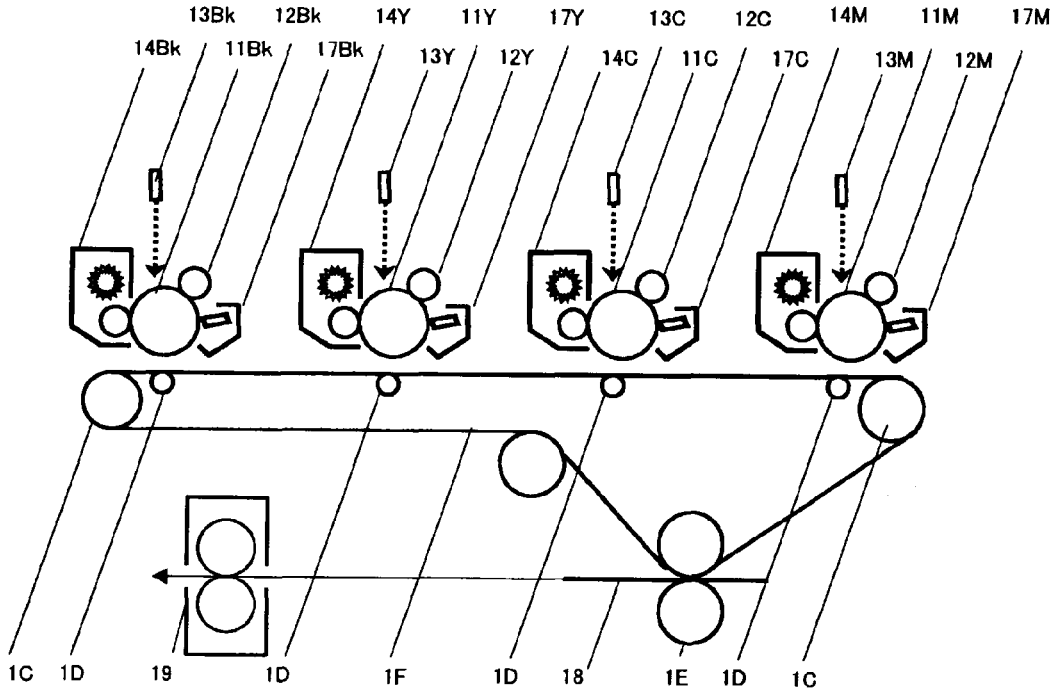
FIG. 6 is a schematic cross-sectional view showing a still another example of an image forming apparatus of the present invention.

FIG. 5 is an another example of a full-color image forming apparatus of the present invention. In this image forming apparatus, four colors of toners, yellow (Y), magenta (M), cyan (C), and black (Bk) are used, and image forming parts are disposed for every colors. In addition, photoconductors 11Y, 11M, 11C and 11Bk are disposed for respective colors. The photoconductor used in the image forming apparatus is a photoconductor which satisfies the requirements of the present invention. Charging units 12Y, 12M, 12C and 12Bk, exposing units 13Y, 13M, 13C and 13Bk, developing units 14Y, 14M, 14C and 14Bk, cleaning units 17Y, 17M, 17C and 17Bk, and the like are disposed around the photoconductors 11Y, 11M, 11C and 11Bk, respectively. A convey and transfer belt 1G as a transfer material bearing member that comes in contact with the transfer positions of the linearly arranged photoconductors 11Y, 11M, 11C and 11Bk, is stretched around driving units 1C. Transfer units 16Y, 16M, 16C and 16Bk are arranged at the transferring position to which the photoconductors 11Y, 11M, 11C and 11Bk face via the convey and transfer belt 1G.

The image forming units described above may be fixed inside a copier, a facsimile machine, or a printer, however, the image forming unit may be contained in a device in a form of a process cartridge. "Process cartridge" is a single device or component which contains a photoconductor therein and further contains a charging unit, an exposing unit, a developing unit, a transferring unit, a cleaning unit, a charge removing unit, and the like.

EXAMPLES

Hereinafter, with referring to Examples and Comparative Examples, the invention is explained in detail and the following Examples and Comparative Examples should not be construed as limiting the scope of this invention. In Examples and Comparative Examples, all part(s) are expressed by mass-basis unless indicated otherwise.

Example 1

A metal-free phthalocyanine was dispersed under the following composition and condition to prepare a pigment dispersion.

| | |
|---|---|
| Metal-free phthalocyanine pigment (FASTOGEN Blue 8120B by Dainippon Ink and Chemicals, Inc.): | 3 parts |
| Cyclohexanone: | 97 parts |

These were dispersed in a glass pot of 9 cm diameter using PSZ balls of 0.5 mm diameter for 5 hours at 100 rpm to prepare a pigment dispersion.

The pigment dispersion was used to prepare a coating liquid for the photosensitive layer of the following composition:

| | |
|---|---|
| The pigment dispersion: | 60 parts |
| The electron transporting material expressed by the Compound 1-1: | 25 parts |
| The hole transporting material expressed by the Compound 2-1: | 25 parts |
| Z-polycarbonate resin (PANLITE TS-2050 by Teijin Chemicals, Ltd.): | 50 parts |
| Silicone oil (KF50 by Shin-Etsu Chemical Co., Ltd.): | 0.01 parts |
| Tetrahydrofuran: | 350 parts |

The coating liquid for the photosensitive layer was coated on an aluminum drum having 30 mm diameter and 340 mm length by dip coating and dried at 120° C. for 20 minutes to form a 25 μm-thick photosensitive layer, thereby yielded a Photoconductor 1.

Example 2

A photoconductor was produced in the same manner as in the Example 1, except that a titanyl phthalocyanine prepared by the following synthesis example was used instead of the metal-free phthalocyanine pigment (FASTOGEN Blue 8120B by Dainippon Ink and Chemicals, Inc.) used in the Example 1. (hereinafter referred to as Photoconductor 2)

<Titanyl Phthalocyanine Used in Example 2>

A pigment was prepared in accordance with the method disclosed in JP-A No. 2001-19871. More specifically, 29.2 g of 1,3-diiminoisoindoline was mixed with 200 ml of sulfolane, and 20.4 g of titanium tetrabutoxide was added dropwise to the mixture under nitrogen flow. Thereafter, the resultant mixture was gradually heated to 180° C., and allowed to react for 5 hours with agitation while the reaction temperature was kept at 170° C. to 180° C. After cooled down, the resulting precipitate was filtered, washed with chloroform until it became blue, washed with methanol for several times, and then washed with 80° C. hot water for several times, and dried to obtain coarse titanyl phthalocyanine particles. The coarse titanyl phthalocyanine particles were dissolved in 20 times volume of concentrated sulfuric acid, and the resulting mixture was added dropwise to 100 times volume of ice water with agitation. The crystals thus precipitated were filtered and repeatedly washed with water until the solution became neutral (pH of ion exchange water was 6.8 after washing). In this way a wet cake (aqueous paste) of a titanyl phthalocyanine pigment was obtained. 40 g of the wet cake was dissolved into 200 g of tetrahydrofuran and agitated for 4 hours, filtered, and then dried to obtain a titanyl phthalocyanine powder.

The solid content density of the wet cake was 15% by mass. The mass ratio of the crystal conversion solvent to the wet cake was 33:1.

The X ray-diffraction spectrum of the obtained titanyl phthalocyanine powder was determined under the following condition, and identified that the titanyl phthalocyanine powder had a maximum diffraction peak at least at a Bragg angle 2θ(±0.2°) of 27.2°, main diffraction peaks at Bragg angles 2θ(±0.20) of 9.4°, 9.6° and 24.0°, a diffraction peak at the smallest Bragg angle 2θ(±0.2°) of 7.3°, and no diffraction peaks at Bragg angles 2θ(±0.2°) between 7.3° and 9.4° in its X-ray diffraction spectrum for CuKα X-ray (1.542 Å wavelength).

Figure 9:
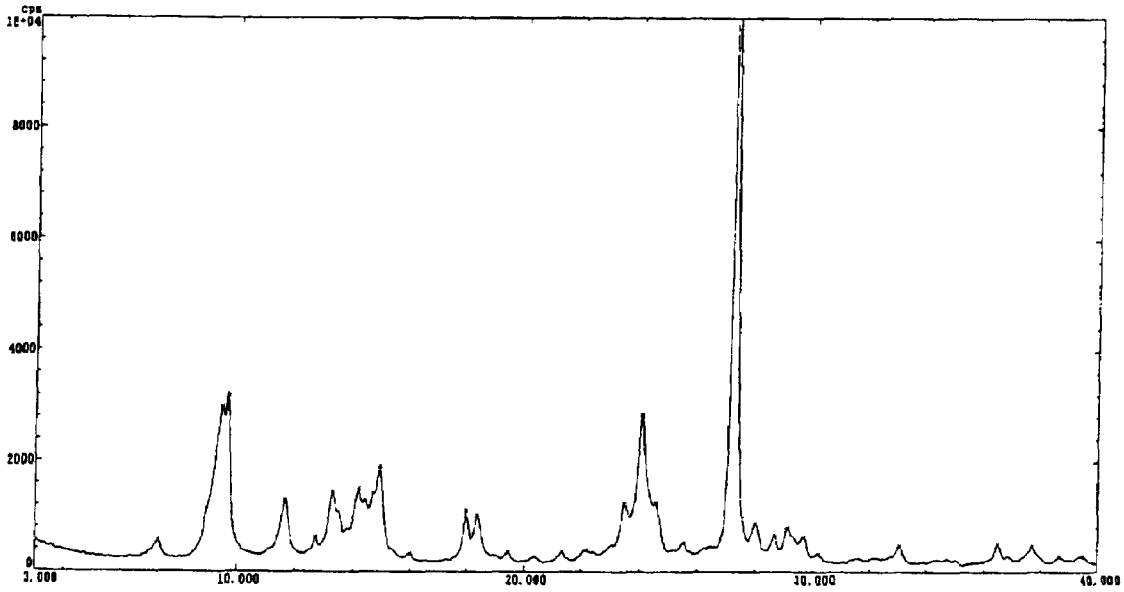
FIG. 9 shows an X-ray diffraction spectrum of the titanyl phthalocyanine synthesized in Examples.

The X-ray diffraction spectrum is shown in FIG. 9.

<Measurement Condition for X-Ray Diffraction Spectrum>

X-ray lamp: Cu

Voltage: 50 kV

Current: 30 mA

Scan speed: 2°/min

Scan range: 3° to 40°

Time constant: 2 seconds

Examples 3 to 15

The photoconductor was produced in the same manner as in the Example 2, except that the electron transporting material and the hole transporting material used in the Example 2 were changed to those shown in Table 3. (hereinafter referred to as Photoconductors 3 to 15).

Comparative Example 1

A photoconductor was produced in the same manner as in the Example 2, except that the hole transporting material used in the Example 2 was changed to a hole transporting material having the following structure (HTM1) (hereinafter referred to as Photoconductor 16).

HTM1

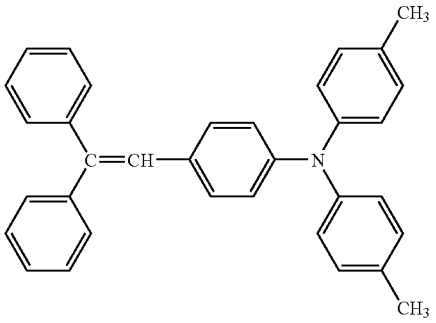

Comparative Example 2

A photoconductor was produced in the same manner as in the Example 2, except that the hole transporting material used in the Example 2 was changed to a hole transporting material having the following structure (HTM2) (hereinafter referred to as Photoconductor 17).

HTM2

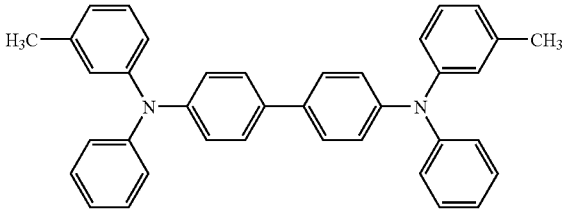

Comparative Example 3

A photoconductor was produced in the same manner as in the Example 2, except that the hole transporting material used in the Example 2 was changed to a hole transporting material having the following structure (HTM3) (hereinafter referred to as Photoconductor 18).

HTM3

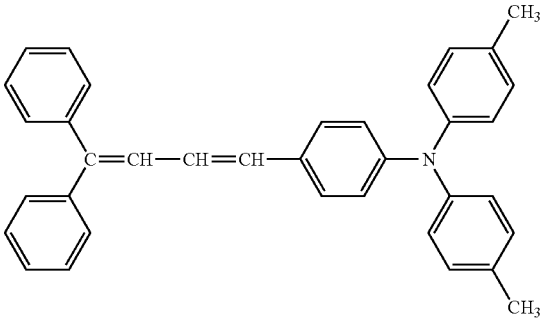

Comparative Example 4

A photoconductor was produced in the same manner as in the Example 2, except that the electron transporting material used in the Example 2 was changed to an electron transporting material having the following structure (ETM1) (hereinafter referred to as Photoconductor 19).

ETM1

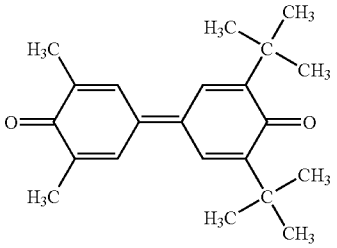

Comparative Example 5

A photoconductor was produced in the same manner as in the Example 2, except that the electron transporting material used in the Example 2 was changed to an electron transporting material having the following structure (ETM2) (hereinafter referred to as Photoconductor 20).

ETM2

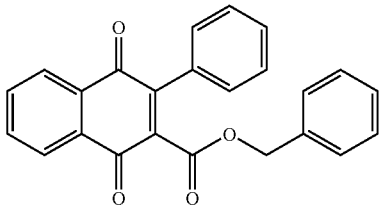

Evaluation Example of Photoconductor 1

Each of the photoconductors 1 to 20 prepared above was mounted in an electrophotographic apparatus, a converted imagio Neo 270 by Ricoh Company, Ltd., in which the power pack was changed for positive charging, and 50,000 sheets were printed out by using a chart of 5% writing ratio for print durability test (uniformly distributed characters accounting for 5% of the entire front surface of an A4-size sheet).

Both the toner and developer that were specifically designed for the imagio Neo 270 were changed to those having a polarity which is opposite to the toner and developer that were specifically designed for the imagio Neo 270.

In the charging unit of the electrophotographic apparatus, an external power source was used to apply bias voltage to a charging roller so that the electric potential of the photoconductor could be +600V at the beginning of the test and maintained until the end of the test. The developing bias was set at +450V. The test was conducted in an environment of 23° C. and 55% RH.

The images (afterimage and resolution) and the electric potential of the exposed area were evaluated before and after the print durability test.

[Image Evaluation]

Figure 10A:
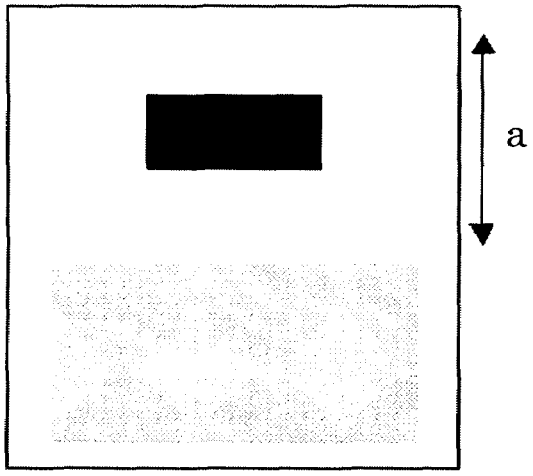
FIG. 10A shows an image for evaluation used in the Evaluation Examples of Photoconductors 1, 2 and 3.
Figure 10B:
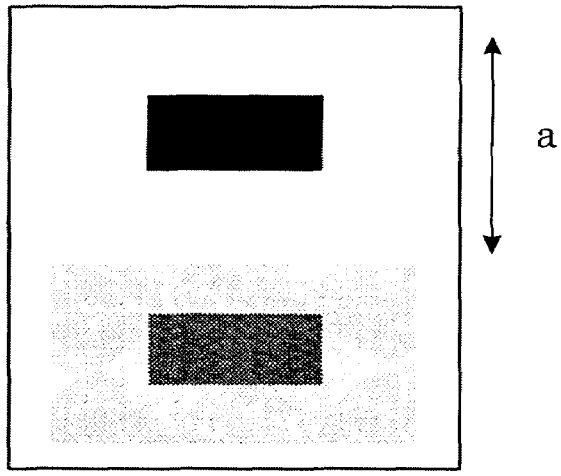
FIG. 10B shows an image for evaluation used in the Evaluation Examples of Photoconductors 1, 2 and 3, in which an afterimage is generated.

As shown in FIGS. 10A and 10B, an image for evaluation containing a black solid image part and a half tone part were output, and then afterimage was evaluated. In the half tone part, the condition of forming a dot, i.e. dot scatter and dot reproducibility, was observed and resolution was evaluated. In FIGS. 10A and 10B "a" denotes a photoconductor pitch.

The afterimage and resolution were evaluated in a scale of the following criteria.

<Evaluation Criteria of Afterimage>

A: No afterimage

B: Subtle afterimage was generated

C: Afterimages were generated

D: Many afterimages were generated (very bad)<

<Evaluation Criteria of Resolution>

A: Excellent

B: Good (dot scatter was slightly observed)

C: Bad (dot scatter and dot spread were observed)

D: Very bad

[Electric Potential of Exposed Area]

The electric potential of the exposed area was obtained in a manner that the photoconductor was primarily charged, exposed imagewise (exposing entire surface), and then moved to the developing part to measure a surface potential of the photoconductor.

The evaluation results are shown in Table 1.

tial of the photoconductor could be +600V at the beginning of the test and maintained until the end of the test. The developing bias was set at +450V. The test was conducted in an environment of 23° C. and 55% RH.

The afterimage and color reproducibility were evaluated after the print durability test.

[Afterimage Evaluation]

As shown in FIGS. 10A and 10B, an image for evaluation containing a black solid image part and a half tone part were output, and afterimage was evaluated. In FIGS. 10A and 10B "a" denotes a photoconductor pitch.

TABLE 1

| | | | | Initial | | | After 50,000 Sheets Printing | | |
|---|---|---|---|---|---|---|---|---|---|
| | Photoconductor | ETM | HTM | Afterimage | Resolution | Electric potential of exposed area (V) | Afterimage | Resolution | Electric potential of exposed area (V) |
| Example 1 | Photoconductor 1 | 1-1 | 2-1 | A | B | 100 | B | B | 150 |
| Example 2 | Photoconductor 2 | 1-1 | 2-1 | A | A | 80 | A | B | 90 |
| Example 3 | Photoconductor 3 | 1-1 | 2-5 | A | A | 60 | A | A | 70 |
| Example 4 | Photoconductor 4 | 1-1 | 2-6 | A | A | 60 | A | A | 70 |
| Example 5 | Photoconductor 5 | 1-1 | 2-7 | A | A | 70 | A | A | 90 |
| Example 6 | Photoconductor 6 | 1-1 | 2-8 | A | A | 80 | A | A | 100 |
| Example 7 | Photoconductor 7 | 1-1 | 2-11 | A | A | 80 | A | B | 110 |
| Example 8 | Photoconductor 8 | 1-1 | 2-13 | A | A | 90 | A | B | 100 |
| Example 9 | Photoconductor 9 | 1-1 | 2-15 | A | A | 90 | A | B | 110 |
| Example 10 | Photoconductor 10 | 1-2 | 2-1 | A | A | 100 | A | B | 130 |
| Example 11 | Photoconductor 11 | 1-6 | 2-1 | A | A | 90 | A | A | 120 |
| Example 12 | Photoconductor 12 | 1-7 | 2-1 | A | A | 90 | A | B | 110 |
| Example 13 | Photoconductor 13 | 1-8 | 2-1 | A | A | 80 | A | A | 120 |
| Example 14 | Photoconductor 14 | 1-9 | 2-1 | A | A | 70 | B | B | 90 |
| Example 15 | Photoconductor 15 | 1-11 | 2-1 | A | A | 80 | A | B | 120 |
| Comparative Example 1 | Photoconductor 16 | 1-1 | HTM1 | A | B | 120 | C | B | 150 |
| Comparative Example 2 | Photoconductor 17 | 1-1 | HTM2 | A | B | 120 | C | C | 160 |
| Comparative Example 3 | Photoconductor 18 | 1-1 | HTM3 | A | B | 90 | C | C | 160 |
| Comparative Example 4 | Photoconductor 19 | ETM1 | 2-1 | A | C | 110 | D | D | 230 |
| Comparative Example 5 | Photoconductor 20 | ETM2 | 2-1 | A | B | 100 | C | C | 140 |

Evaluation Example of Photoconductor 2

Each of the photoconductors 1 to 20 prepared above was mounted in a full-color tandem electrophotographic apparatus, a converted IPSiO Color8100 by Ricoh Company, Ltd., in which the power pack was changed for positive charging and the writing wavelength of the laser diode was changed to 780 nm, and 10,000 sheets were printed out by using a chart of 5% writing ratio for print durability test (uniformly distributed characters accounting for 5% of the entire front surface of an A4-size sheet).

Both the toner and developer that were specifically designed for the IPSiO Color8100 were changed to those having a polarity which is opposite to the toner and developer that were specifically designed for the IPSiO Color8100.

In the charging unit of the electrophotographic apparatus, an external power source was used to apply voltage of AC component to a charging roller at a peak to peak voltage of 1.9 kV having a frequency of 1.35 kHz, and to apply voltage of a DC component to a charging roller so that the electric poten- The afterimage was evaluated in the following criteria.

<Evaluation Criteria of Afterimage>

A: No afterimage

B: Subtle afterimage was generated

C: Afterimages were generated

D: Many afterimages were generated (very bad)

[Color Reproducibility]

ISO/JIS-SCID image N1 (portrait) was output, and the color reproducibility was evaluated.

The color reproducibility was evaluated in the following criteria.

<Evaluation Criteria of Color Reproducibility>

A: Excellent

B: Good

C: Slightly inferior

D: Very bad

The evaluation results are shown in Table 2.

TABLE 2

| | Photoconductor | ETM | HTM | Afterimage | Color reproducibility |
|---|---|---|---|---|---|
| Example 1 | Photoconductor 1 | 1-1 | 2-1 | A | B |
| Example 2 | Photoconductor 2 | 1-1 | 2-1 | A | B |
| Example 3 | Photoconductor 3 | 1-1 | 2-5 | A | A |

TABLE 2-continued

| | Photoconductor | ETM | HTM | Afterimage | Color reproducibility |
|---|---|---|---|---|---|
| Example 4 | Photoconductor 4 | 1-1 | 2-6 | A | A |
| Example 5 | Photoconductor 5 | 1-1 | 2-7 | A | A |
| Example 6 | Photoconductor 6 | 1-1 | 2-8 | A | A |
| Example 7 | Photoconductor 7 | 1-1 | 2-11 | A | A |
| Example 8 | Photoconductor 8 | 1-1 | 2-13 | A | B |
| Example 9 | Photoconductor 9 | 1-1 | 2-15 | A | B |
| Example 10 | Photoconductor 10 | 1-2 | 2-1 | A | B |
| Example 11 | Photoconductor 11 | 1-6 | 2-1 | A | A |
| Example 12 | Photoconductor 12 | 1-7 | 2-1 | A | A |
| Example 13 | Photoconductor 13 | 1-8 | 2-1 | A | A |
| Example 14 | Photoconductor 14 | 1-9 | 2-1 | A | A |
| Example 15 | Photoconductor 15 | 1-11 | 2-1 | A | A |
| Comparative Example 1 | Photoconductor 16 | 1-1 | HTM1 | C | B |
| Comparative Example 2 | Photoconductor 17 | 1-1 | HTM2 | C | B |
| Comparative Example 3 | Photoconductor 18 | 1-1 | HTM3 | C | B |
| Comparative Example 4 | Photoconductor 19 | ETM1 | 2-1 | D | C |
| Comparative Example 5 | Photoconductor 20 | ETM2 | 2-1 | C | C |

Example 16

A metal-free phthalocyanine was dispersed under the following composition and condition to prepare a pigment dispersion.

| | |
|---|---|
| Metal-free phthalocyanine pigment (FASTOGEN Blue 8120B by Dainippon Ink and Chemicals, Inc.): | 3 parts |
| Cyclohexanone: | 97 parts |

These were dispersed in a glass pot of 9 cm diameter using PSZ balls of 0.5 mm diameter for 5 hours at 100 rpm to prepare a pigment dispersion.

The pigment dispersion was used to prepare a coating liquid for the photosensitive layer of the following composition:

| | |
|---|---|
| The pigment dispersion: | 60 parts |
| The electron transporting material expressed by the Compound 1-1: | 20 parts |
| The hole transporting material expressed by the following structure (HTM1): | 30 parts |

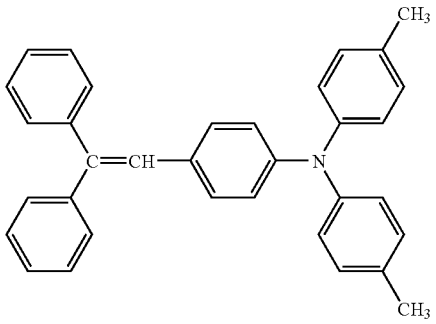

(HTM1)

-continued

| | |
|---|---|
| The organic sulfur antioxidant expressed by the Compound 2-1: | 1 part |
| Z-polycarbonate resin (PANLITE TS-2050 by Teijin Chemicals, Ltd.): | 50 parts |
| Silicone oil (KF50 by Shin-Etsu Chemical Co., Ltd.): | 0.01 parts |
| Tetrahydrofuran: | 350 parts |

The coating liquid for the photosensitive layer was coated on an aluminum drum having 30 mm diameter and 340 mm length by dip coating and dried at 120° C. for 20 minutes to form a 25 μm-thick photosensitive layer, thereby yielded a Photoconductor 21.

Example 17

A photoconductor was produced in the same manner as in the Example 16, except that the titanyl phthalocyanine used in the Example 2 was used instead of the metal-free phthalocyanine pigment (FASTOGEN Blue 8120B by Dainippon Ink and Chemicals, Inc.) used in the Example 16. (hereinafter referred to as Photoconductor 22).

Examples 18 to 28

A photoconductor was produced in the same manner as in the Example 17, except that the electron transporting material and the organic sulfur antioxidant used in the Example 17 was changed to those shown in Table 3. (hereinafter referred to as Photoconductors 23 to 33).

Example 29

A photoconductor was produced in the same manner as in the Example 17, except that the hole transporting material used in the Example 17 was changed to a hole transporting material having the following structure (HTM2) (hereinafter referred to as Photoconductor 34).

(HTM2)

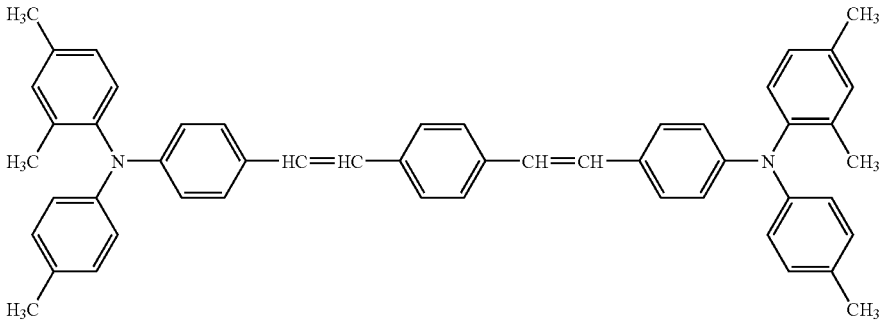

Example 30

A photoconductor was produced in the same manner as in the Example 17, except that the hole transporting material used in the Example 17 was changed to a hole transporting material having the following structure (HTM3) (hereinafter referred to as Photoconductor 35).

(HTM3)

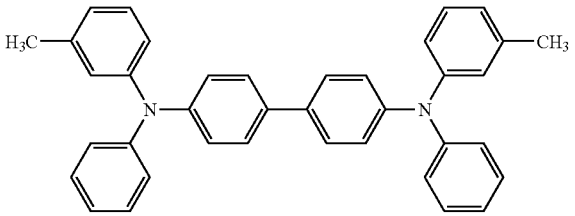

Comparative Example 6

A photoconductor was produced in the same manner as in the Example 17, except that the organic sulfur antioxidant used in the Example 17 was not added. (hereinafter referred to as photoconductor 36).

Comparative Example 7

A photoconductor was produced in the same manner as in the Example 17, except that the organic sulfur antioxidant used in the Example 17 was changed to an antioxidant having the following structure (AO1) (hereinafter referred to as Photoconductor 37).

(AO1)

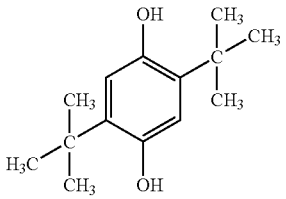

Comparative Example 8

A photoconductor was produced in the same manner as in the Example 17, except that the organic sulfur antioxidant used in the Example 17 was changed to an antioxidant having the following structure (AO2) (hereinafter referred to as Photoconductor 38).

(AO2)

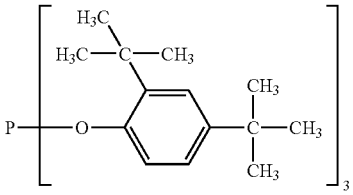

Comparative Example 9

A photoconductor was produced in the same manner as in the Example 17, except that the organic sulfur antioxidant used in the Example 17 was changed to an antioxidant having the following structure (AO3) (hereinafter referred to as Photoconductor 39).

(AO3)

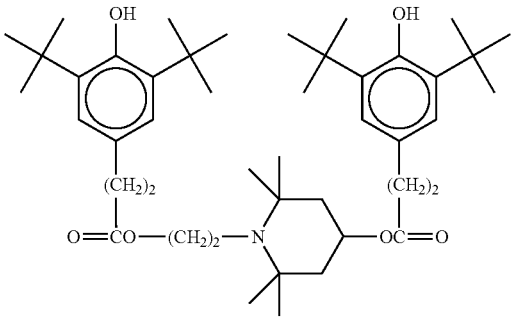

Comparative Example 10

A photoconductor was produced in the same manner as in the Example 17, except that the electron transporting material used in the Example 17 was changed to an electron transporting material having the following structure (ETM1) (hereinafter referred to as Photoconductor 40).

(ETM1)

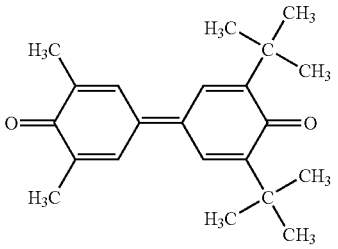

Comparative Example 11

A photoconductor was produced in the same manner as in the Example 17, except that the electron transporting material used in the Example 17 was changed to an electron transporting material having the following structure (ETM2) (hereinafter referred to as Photoconductor 41).

(ETM2)

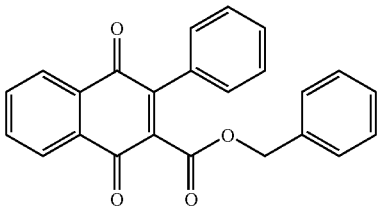

Evaluation Example of Photoconductor 3

Each of the photoconductors 21 to 41 prepared above was mounted in an image forming apparatus, a converted imagio Neo 270 by Ricoh Company, Ltd., in which the power pack was changed for positive charging, and 50,000 sheets were printed out by using a chart of 5% writing ratio for print durability test (uniformly distributed characters accounting for 5% of the entire front surface of an A4-size sheet).

Both the toner and developer that were specifically designed for the imagio Neo 270 were changed to those having a polarity which is opposite to the toner and developer that were specifically designed for the imagio Neo 270.

In the charging unit of the image forming apparatus, an external power source was used to apply bias voltage to a charging roller so that the electric potential of the photoconductor could be +600V at the beginning of the test and maintained until the end of the test. The developing bias was set at +450V. The test was conducted in an environment of 23° C. and 55% RH.

The afterimage and the electric potential of the exposed area were evaluated before and after the print durability test.

[Afterimage Evaluation]

As shown in FIGS. 10A and 10B, an image for evaluation containing a black solid image part and a half tone part were output, and afterimage was evaluated. In FIGS. 10A and 10B "a" denotes a photoconductor pitch. The afterimage were evaluated in a scale of the following criteria.

<Evaluation Criteria of Afterimage>

A: No afterimage

B: Subtle afterimage was generated

C: Afterimages were generated

D: Many afterimages were generated (very bad)

[Electric Potential of Exposed Area]

The electric potential of the exposed area was obtained in a manner that the photoconductor was primarily charged at +600V, exposed imagewise (exposing entire surface), and then moved to the developing part to measure a surface potential of the photoconductor.

The electric potential of the surface of the photoconductor was measured by a surface potential measuring device which was equipped in the developing part.

The results are shown in Table 3

TABLE 3

| | | | | | Initial | | After 50,000 Sheets Printing | |
|---|---|---|---|---|---|---|---|---|
| | Photoconductor | ETM | HTM | Antioxidant | Afterimage | Electric potential of exposed area (V) | Afterimage | Electric potential of exposed area (V) |
| Example 16 | Photoconductor 21 | 1-1 | HTM1 | 3-1 | A | 90 | A | 100 |
| Example 17 | Photoconductor 22 | 1-1 | HTM1 | 3-1 | A | 100 | A | 125 |
| Example 18 | Photoconductor 23 | 1-1 | HTM1 | 3-3 | A | 105 | A | 125 |
| Example 19 | Photoconductor 24 | 1-1 | HTM1 | 3-5 | A | 110 | A | 130 |
| Example 20 | Photoconductor 25 | 1-1 | HTM1 | 3-6 | A | 105 | A | 130 |
| Example 21 | Photoconductor 26 | 1-1 | HTM1 | 4-1 | A | 120 | B | 150 |
| Example 22 | Photoconductor 27 | 1-2 | HTM1 | 3-1 | A | 105 | A | 125 |
| Example 23 | Photoconductor 28 | 1-6 | HTM1 | 3-2 | A | 110 | A | 135 |
| Example 24 | Photoconductor 29 | 1-7 | HTM1 | 3-3 | A | 110 | A | 130 |
| Example 25 | Photoconductor 30 | 1-8 | HTM1 | 3-4 | A | 110 | A | 130 |
| Example 26 | Photoconductor 31 | 1-9 | HTM1 | 3-5 | A | 105 | A | 135 |
| Example 27 | Photoconductor 32 | 1-11 | HTM1 | 3-6 | A | 110 | A | 130 |
| Example 28 | Photoconductor 33 | 1-13 | HTM1 | 3-1 | A | 120 | B | 155 |
| Example 29 | Photoconductor 34 | 1-1 | HTM2 | 3-1 | A | 90 | A | 100 |
| Example 30 | Photoconductor 35 | 1-1 | HTM3 | 3-1 | A | 100 | A | 130 |
| Comparative Example 6 | Photoconductor 36 | 1-1 | HTM1 | None | A | 100 | C | 120 |
| Comparative Example 7 | Photoconductor 37 | 1-1 | HTM1 | AO1 | A | 150 | D | 330 |
| Comparative Example 8 | Photoconductor 38 | 1-1 | HTM1 | AO2 | A | 130 | D | 290 |
| Comparative Example 9 | Photoconductor 39 | 1-1 | HTM1 | AO3 | A | 100 | C | 125 |
| Comparative Example 10 | Photoconductor 40 | ETM1 | HTM1 | 3-1 | A | 180 | D | 250 |
| Comparative Example 11 | Photoconductor 41 | ETM2 | HTM1 | 3-1 | A | 140 | C | 210 |

Evaluation Example of Photoconductor 4

Moreover, the charge property of the Photoconductors 22 to 26 and 36 to 41 were evaluated before and after the print durability test.

A converted imagio Neo 270 by Ricoh Company, Ltd., in which a surface potential measuring device was equipped in a developing part, an external power source was used for a charging unit, and charge polarity can be freely changed, was used to evaluate positive and negative charge properties.

<Evaluation Method>

[Evaluation of Positive Charge Property]

A predetermined charge condition was set such that the electric potential of the Photoconductor 36 was at +500V at the beginning of the test, and under the predetermined charge condition the electric potential of the other photoconductors were measured. The positive charge property after print durability test was evaluated under the same charge condition.

[Evaluation of Negative Charge Property]

A predetermined charge condition was set such that the electric potential of the Photoconductor 36 was at −500V at the beginning of the test, and under the predetermined charge condition the electric potential of the other photoconductors were measured. The negative charge property after print durability test was evaluated under the same charge condition.

The results are shown in Table 4.

TABLE 4

| | | | | Initial | | After 50,000 Sheets Printing | |
|---|---|---|---|---|---|---|---|
| Photoconductor | ETM | HTM | Antioxidant | Positive charge (V) | Negative charge (−V) | Positive charge (V) | Negative charge (−V) |
| Photoconductor 22 | 1-1 | HTM1 | 3-1 | 520 | 480 | 510 | 260 |
| Photoconductor 23 | 1-1 | HTM1 | 3-3 | 525 | 480 | 510 | 255 |
| Photoconductor 24 | 1-1 | HTM1 | 3-5 | 530 | 485 | 515 | 255 |
| Photoconductor 25 | 1-1 | HTM1 | 3-6 | 520 | 490 | 510 | 265 |
| Photoconductor 26 | 1-1 | HTM1 | 4-1 | 520 | 480 | 500 | 250 |
| Photoconductor 36 | 1-1 | HTM1 | None | 500 | 500 | 380 | 420 |
| Photoconductor 37 | 1-1 | HTM1 | AO1 | 530 | 520 | 400 | 420 |
| Photoconductor 38 | 1-1 | HTM1 | AO2 | 530 | 530 | 420 | 440 |
| Photoconductor 39 | 1-1 | HTM1 | AO3 | 500 | 505 | 500 | 480 |
| Photoconductor 40 | ETM1 | HTM1 | 3-1 | 490 | 510 | 350 | 380 |
| Photoconductor 41 | ETM2 | HTM1 | 3-1 | 500 | 500 | 350 | 370 |

As can be seen from the Examples 16 to 30, the photoconductor which satisfies the requirement of the present invention does not generate afterimage after repeated use, and the electric potential of the exposed area less fluctuates. Therefore, the image forming apparatus of the present invention can output high quality image without generating an abnormal image such as afterimage for a long period.

From the result of the Evaluation Example of Photoconductor 4, the photoconductor which satisfies the requirement of the present invention can maintain high positive charge property even after repeated use. On the other hand, the Photoconductor 39 which uses AO3 as the antioxidant maintains positive charge property, but the afterimage is generated (see the result of the Comparative Example 9). In the photoconductor of the present invention, the negative charge property is significantly reduced, thus it is assumed that the photoconductor is prevented from being negatively charged in the transferring step, and the afterimage is not generated.

What is claimed is:

1. An electrophotographic photoconductor comprising:

a photosensitive layer; and a conductive substrate, wherein the photosensitive layer is disposed on the conductive substrate, and the photosensitive layer is a single layer which comprises a charge generating material, an electron transporting material expressed by the Structural Formula 1-9 and a hole transporting material expressed by the General Formula (2):

1-9

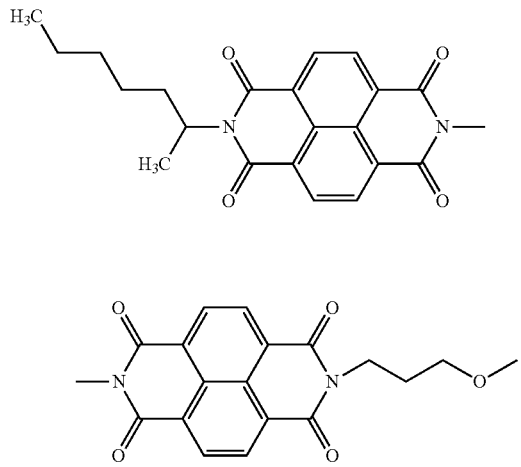

-continued

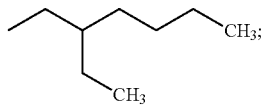

and

General Formula (2)

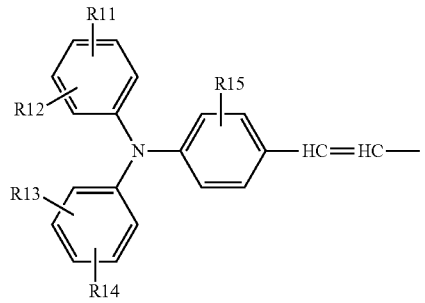

-continued

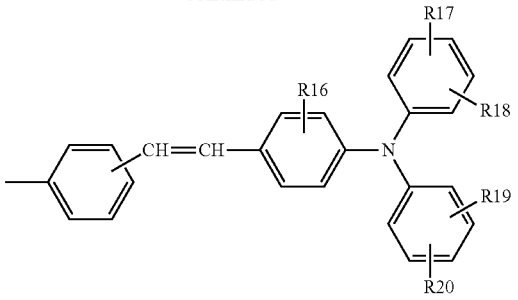

wherein R11, R12, R13, R14, R17, R18, R19 and R20 each represents a hydrogen atom, halogen atom, alkoxy group, alkyl group which may be substituted or aryl group which may be substituted, R15 and R16 each is selected from the group consisting of a hydrogen atom, halogen atom, alkyl group, and alkoxy group.

2. The electrophotographic photoconductor according to claim 1, wherein the charge generating material is phthalocyanine.

3. The electrophotographic photoconductor according to claim 2, wherein the phthalocyanine is titanyl phthalocyanine.

4. The electrophotographic photoconductor according to claim 3, wherein the titanyl phthalocyanine has a maximum diffraction peak at least at a Bragg angle 2θ(±0.2°) of 27.2°, main diffraction peaks at Bragg angles 2θ(±0.2°) of 9.4°, 9.6° and 24.0°, a diffraction peak at the smallest Bragg angle 2θ(±0.2°) of 7.3°, and no diffraction peaks at Bragg angles 2θ(±0.2°)between 7.3° and 9.4° in its X-ray diffraction spectrum for CuKα X-ray (1.542 Å wavelength).

5. A process cartridge for an image forming apparatus, comprising:

an electrophotographic photoconductor, wherein the electrophotographic photoconductor comprises:

a photosensitive layer; and a conductive substrate, wherein the photosensitive layer is disposed on the conductive substrate, and the photosensitive layer is a single layer which comprises a charge generating material, an electron transporting material expressed by the Structural Formula 1-9 and a hole transporting material expressed by the General Formula (2):

1-9

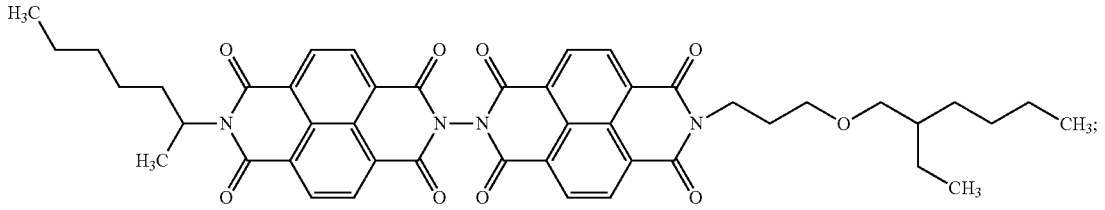

General Formula (2)

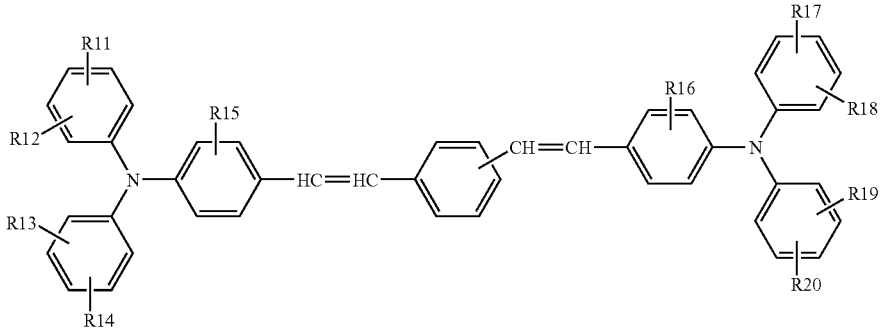

wherein R11, R12, R13, R14, R17, R18, R19 and R20 each represents a hydrogen atom, halogen atom, alkoxy group, alkyl group which may be substituted or aryl group which may be substituted, R15 and R16 each is selected from the group consisting of a hydrogen atom, halogen atom, alkyl group, and alkoxy group, and wherein the process cartridge for the image forming apparatus is detachably attached to the image forming apparatus.

6. An image forming apparatus comprising:

an electrophotographic photoconductor, wherein the electrophotographic photoconductor comprises:

a photosensitive layer; and a conductive substrate, wherein the photosensitive layer is disposed on the conductive substrate, and the photosensitive layer is a single layer which comprises a charge generating material, an electron transporting material expressed by the Structural Formula 1-9 and a hole transporting material expressed by the General Formula (2):

1-9

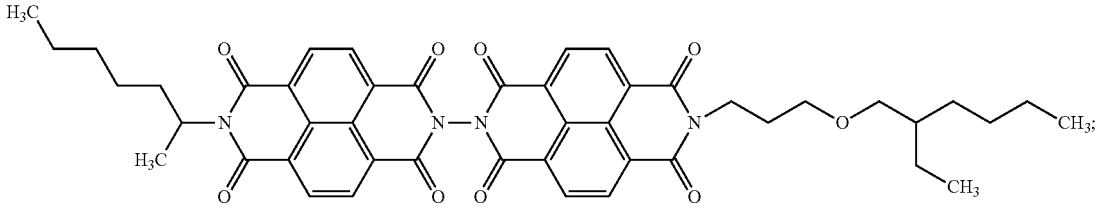

and

General Formula (2)

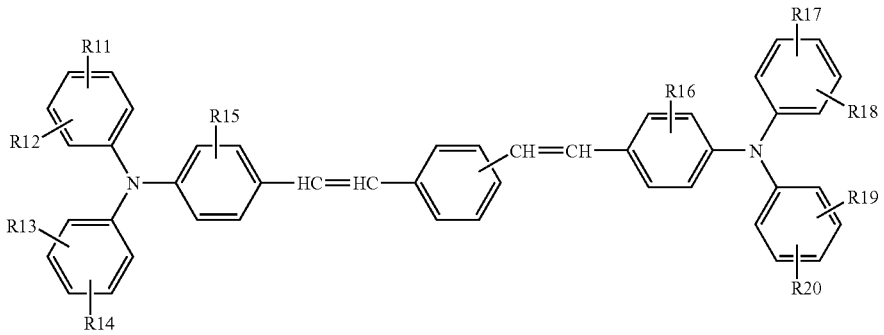

wherein R11, R12, R13, R14, R17, R18, R19 and R20 each represents a hydrogen atom, halogen atom, alkoxy group, alkyl group which may be substituted or aryl group which may be substituted, R15 and R16 each is selected from the group consisting of a hydrogen atom, halogen atom, alkyl group, and alkoxy group.

7. An image forming apparatus comprising:

a process cartridge for an image forming apparatus, wherein the process cartridge for the image forming apparatus, comprises:

an electrophotographic photoconductor, wherein the electrophotographic photoconductor comprises:

a photosensitive layer; and a conductive substrate, wherein the photosensitive layer is disposed on the conductive substrate, and the photosensitive layer is a single layer which comprises a charge generating material, an electron transporting material expressed by the Structural Formula 1-9 and a hole transporting material expressed by the General Formula (2):

1-9

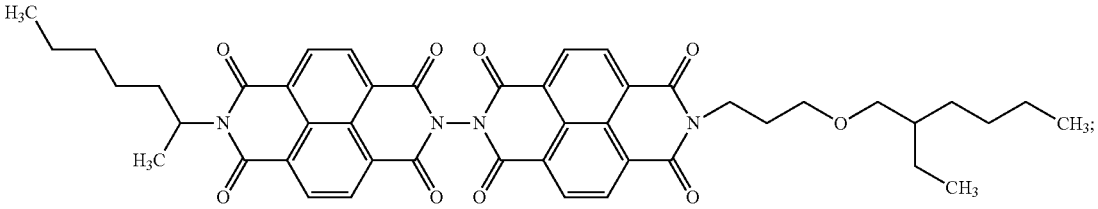

General Formula (2)

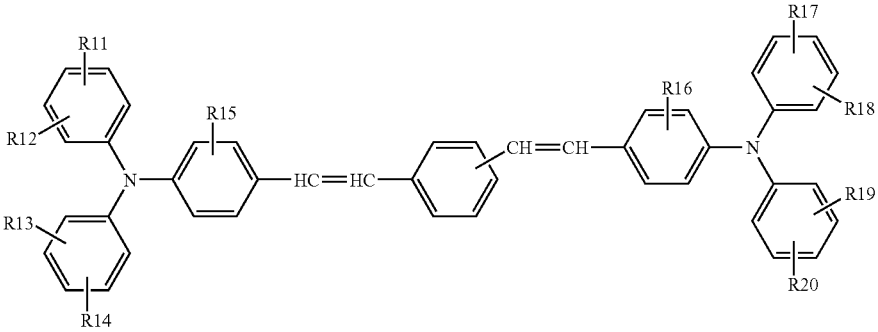

wherein R11, R12, R13, R14, R17, R18, R19 and R20 each represents a hydrogen atom, halogen atom, alkoxy group, alkyl group which may be substituted or aryl group which may be substituted, R15 and R16 each is selected from the group consisting of a hydrogen atom, halogen atom, alkyl group, and alkoxy group, and wherein the process cartridge for the image forming apparatus is detachably attached to the image forming apparatus.

8. An image forming apparatus comprising:

a plurality of process cartridges for an image forming apparatus, wherein the process cartridge for the image forming apparatus, comprises:

an electrophotographic photoconductor, wherein the electrophotographic photoconductor comprises:

a photosensitive layer; and a conductive substrate, wherein the photosensitive layer is disposed on the conductive substrate, and the photosensitive layer is a single layer which comprises a charge generating material, an electron transporting material expressed by the Structural Formula 1-9 and a hole transporting material expressed by the General Formula (2):

1-9

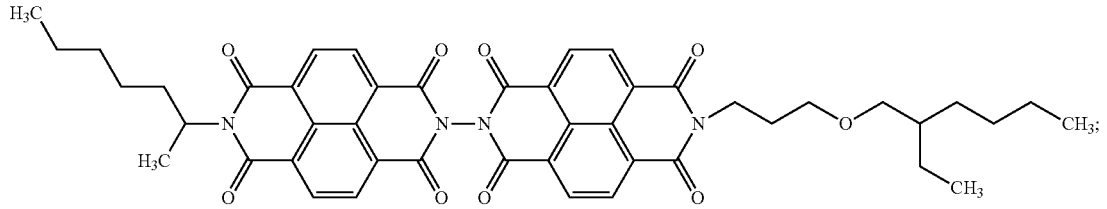

General Formula (2)

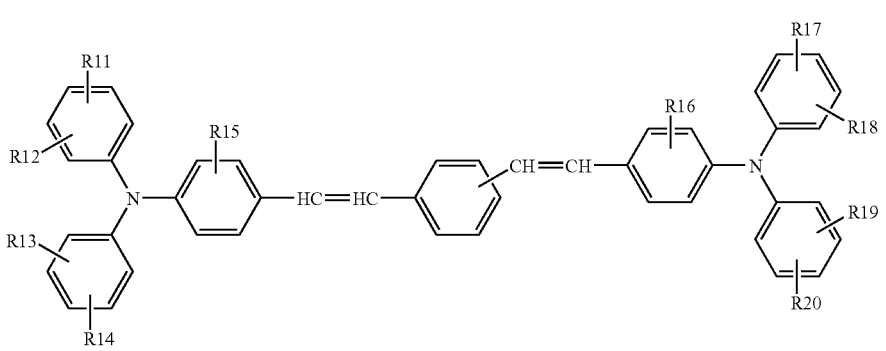

wherein R11, R12, R13, R14, R17, R18, R19 and R20 each represents a hydrogen atom, halogen atom, alkoxy group, alkyl group which may be substituted or aryl group which may be substituted, R15 and R16 each is selected from the group consisting of a hydrogen atom, halogen atom, alkyl group, and alkoxy group, and wherein the process cartridge for the image forming apparatus is detachably attached to the image forming apparatus.

9. An electrophotographic photoconductor comprising:

a photosensitive layer; and a conductive substrate, wherein the photosensitive layer is disposed on the conductive substrate and the photosensitive layer is a single layer which comprises a charge generating material, an organic sulfur antioxidant and an electron transporting material expressed by the Structural Formula 1-9, and a hole transporting material selected from the group consisting of compounds of Structural Formulae HTM1, HTM2 and HTM3;

1-9

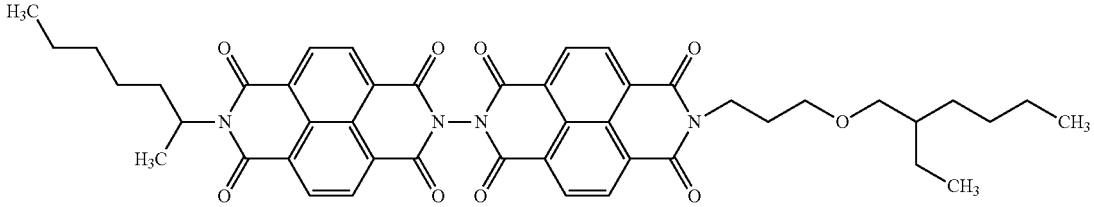

HTM1

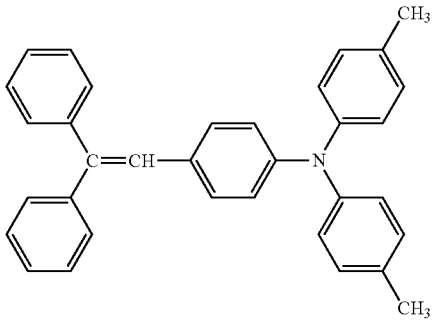

HTM2

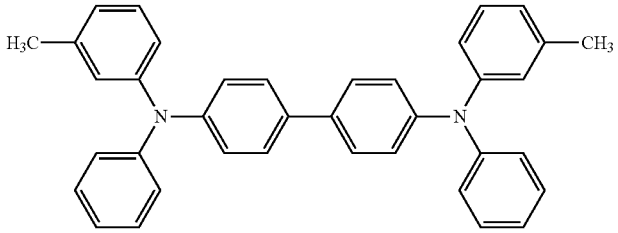

HTM3

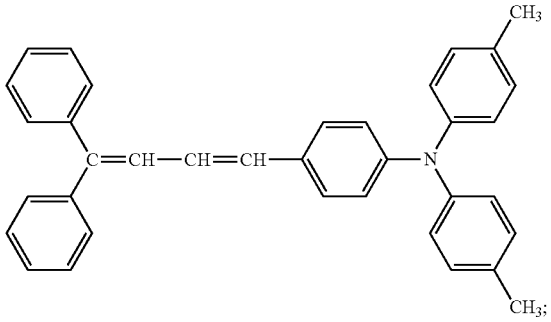

wherein the organic sulfur antioxidant is selected from the group consisting of compounds of Structural Formulae 3-1 to 3-6;

$S—(CH_2CH_2COOC_8H_{17})_2$ 3-1

$S—(CH_2CH_2COOC_{12}H_{25})_2$ 3-2

$S—(CH_2CH_2COOC_{13}H_{27})_2$ 3-3

$S—(CH_2CH_2COOC_{14}H_{29})_2$ 3-4

$S—(CH_2CH_2COOC_{18}H_{37})_2$ 3-5

$S—(CH_2CH_2COOC_{22}H_{45})_2$ 3-6; and wherein the charge generating material is a titanyl phthalocyanine having a maximum diffraction peak at least at a Bragg angle 2θ(±0.2°) of 27.2°, main diffraction peaks at Bragg angles 2θ(±0.2°) of 9.4°, 9.6° and 24.0°, a diffraction peak at the smallest Bragg angle 2θ(±0.2°) of 7.3°, and no diffraction peaks at Bragg angles 2θ(±0.2°) between 7.3° and 9.4° in its X-ray diffraction spectrum for CuKα X-ray (1.542 Åwavelength).

* * * * *